US010688523B2

(12) United States Patent
Skinner et al.

(10) Patent No.: US 10,688,523 B2
(45) Date of Patent: Jun. 23, 2020

(54) SOLID MARKING MATERIAL MELTING APPLICATOR WAND

(71) Applicant: CRAYOLA, LLC, Easton, PA (US)

(72) Inventors: Craig Skinner, Nazareth, PA (US); Douglas Brand, Easton, PA (US); Scott Collins, Nazareth, PA (US); Thomas R. Rau, Easton, PA (US); Ramy Hanna, Easton, PA (US); Gregory R. Nungester, Asbury, NJ (US); Jennifer Weikel, Easton, PA (US)

(73) Assignee: Crayola LLC, Easton, PA (US)

( * ) Notice: Subject to any disclaimer, the term of this patent is extended or adjusted under 35 U.S.C. 154(b) by 34 days.

(21) Appl. No.: 15/923,913

(22) Filed: Mar. 16, 2018

(65) Prior Publication Data

US 2018/0272379 A1 Sep. 27, 2018

Related U.S. Application Data

(60) Provisional application No. 62/638,683, filed on Mar. 5, 2018, provisional application No. 62/475,007, filed on Mar. 22, 2017.

(51) Int. Cl.

| | |
|---|---|
| ***A47L 13/32*** | (2006.01) |
| ***B05C 17/005*** | (2006.01) |
| ***A46B 11/08*** | (2006.01) |
| ***A46B 11/00*** | (2006.01) |
| ***B43K 19/00*** | (2006.01) |
| ***B44D 3/22*** | (2006.01) |
| *B05B 15/62* | (2018.01) |

(52) U.S. Cl.

CPC ..... *B05C 17/00526* (2013.01); *A46B 11/001* (2013.01); *A46B 11/08* (2013.01); *B05C 17/00523* (2013.01); *B43K 19/00* (2013.01); *B44D 3/22* (2013.01); *A46B 2200/202* (2013.01); *A46B 2200/205* (2013.01); *B05B 15/62* (2018.02)

(58) Field of Classification Search

CPC ..... B05C 17/00523; B05C 17/00526; B44D 3/22

USPC ..... 401/1, 2

See application file for complete search history.

(56) References Cited

U.S. PATENT DOCUMENTS 1,767,079 A * 6/1930 Kenyon ..... B29B 13/022 219/421

4,998,698 A * 3/1991 Martinson ..... B05C 17/00523 211/60.1

(Continued)

FOREIGN PATENT DOCUMENTS

CN 109466231 A * 3/2019

*Primary Examiner* — Jennifer C Chiang

(74) *Attorney, Agent, or Firm* — Shook, Hardy and Bacon LLP

(57) ABSTRACT

Aspects herein relate to an applicator wand that is configured to melt a solid marking material and apply the melted marking material onto a receiving medium. Aspects of the applicator wand include a heating and melting element enclosed within an external casing, a receiving compartment configured to receive one or more solid marking materials, and an applicator tip for applying the melted marking material onto a receiving medium to create a design, drawing, picture, sketch, and the like on the receiving medium.

20 Claims, 21 Drawing Sheets

(56) References Cited

U.S. PATENT DOCUMENTS

| | | | | |
|---|---|---|---|---|
| 5,395,175 | A * | 3/1995 | Bontoux | A45D 26/0014 401/1 |
| 5,688,421 | A * | 11/1997 | Walton | B05C 17/00526 219/230 |
| 6,076,984 | A * | 6/2000 | Legrain | A45D 26/0014 401/1 |
| 6,255,625 | B1 * | 7/2001 | Baschenis | A61C 13/0028 219/227 |
| 6,840,403 | B2 | 1/2005 | Girouard | |
| 8,921,746 | B2 * | 12/2014 | Baarman | A45D 40/261 219/660 |
| 9,278,572 | B2 * | 3/2016 | Kamins | B43K 19/00 |
| 10,245,604 | B2 * | 4/2019 | Foreman | B05B 9/002 |
| 2015/0293452 | A1 | 10/2015 | Kamins et al. | |

* cited by examiner

SOLID MARKING MATERIAL MELTING APPLICATOR WAND

CROSS-REFERENCE TO RELATED APPLICATIONS

This application entitled "Solid Marking Material Melting Applicator Wand," is a Non-provisional Application claiming priority to both U.S. Provisional Patent Application No. 62/475,007, entitled "Solid Marking Material Melting Applicator Wand," filed on Mar. 22, 2017, and U.S. Provisional Patent Application No. 62/638,683, entitled "Solid Marking Material Melting Applicator Wand," filed on Mar. 5, 2018. The entirety of the aforementioned applications are incorporated by reference herein.

STATEMENT REGARDING FEDERALLY SPONSORED RESEARCH OR DEVELOPMENT

Not applicable.

TECHNICAL FIELD

Aspects herein relate to crafting wands for creating melted wax art.

BACKGROUND OF THE INVENTION

Wax compositions have long been used for making solid marking materials of different colors. Such solid marking materials may include, for example, crayons, oil pastels, and the like that have a wax or similar pigmented medium for delivering a particular color or colors onto a receiving medium. These solid marking materials may come in a plethora of colors and compositions, which give people of all ages an avenue of unlimited creativity.

Because of their pigmented wax composition however, the colors of the solid marking materials may not transfer smoothly to a receiving medium made of materials such as paper, plastic, glass, ceramic, fabric, primed surfaces, gesso-treated surfaces, and the like. In other words, in their solid state, the colors from pigmented wax compositions may transfer partially, giving the colored image on the receiving medium a non-uniform or uneven look, especially when observing from up close. This effect may be caused by an uneven "sticking" of the solid marking material on the receiving medium.

BRIEF DESCRIPTION OF THE DRAWINGS

Aspects herein is described in detail below with reference to the attached drawing figures, wherein.

DETAILED DESCRIPTION OF THE INVENTION

Figure 1:
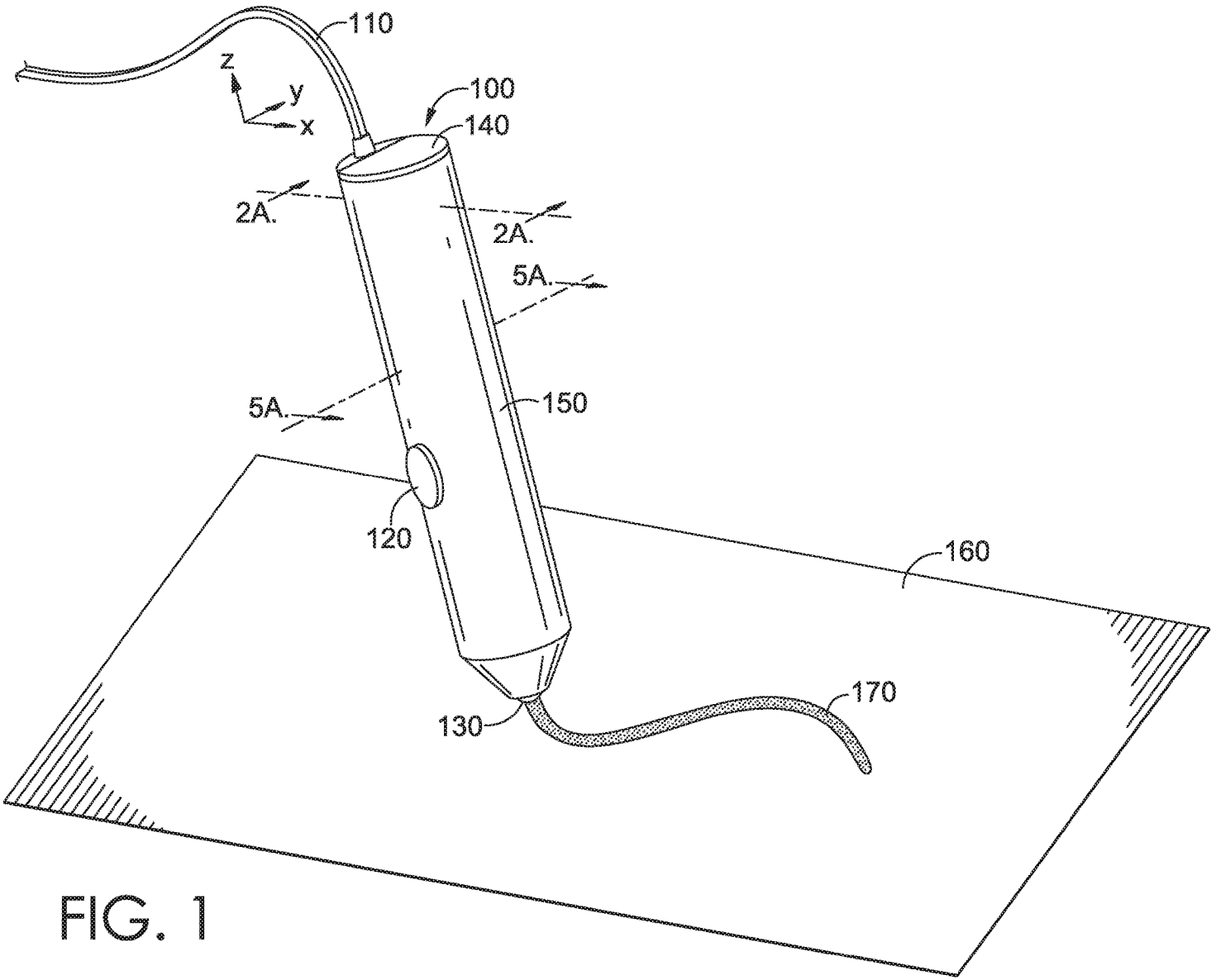
FIG. 1 depicts an applicator wand in use, in accordance with aspects herein.

Aspects herein provide a device for creating single-color and multi-colored images or designs using melted wax as the coloring medium. Such solid marking materials may comprise, for example, crayons, oil pastels, and the like. The solid marking materials may comprise pigmentation of a different array of colors, they may comprise non-melting particles, flecks, flakes, and the like of a different array of sizes and shapes to provide special effects such as, for example, metallic effects, glitter effects, and the like. As such, the solid marking materials utilized for coloring with the device described herein may be any solid marking material, such as a crayon, that is melted at a threshold temperature into a fluid, drawing medium.

Specifically, an applicator wand for melting wax-based solid marking materials is provided in accordance with aspects herein. For ease of description, the applicator wand will hereinafter be described as using crayons as the solid marking material medium. However, one of ordinary skill in the art will understand that the applicator wand may be used to melt any wax-based element or any solid oil based element that is not necessarily a crayon, but may comprise other meltable pigmented medium such as, for example, a candle wax stick, oil pastels, and the like. In some aspects, the applicator wand may be configured to melt and selectively dispense a desired solid marking material or combination of solid marking materials to provide a fluid marking tool operating within a threshold melting and marking temperature range.

The applicator wand in accordance with aspects herein may comprise an ergonomic design to be handled as, for example, a common writing utensil such as a pen, marker, brush, paintbrush, and the like. Further, the applicator wand may comprise a receiving compartment for receiving and storing a wax-based solid marking material such as a crayon and a melting compartment where the crayon is melted prior to passing on to an applicator tip for application of the melted crayon onto a receiving surface comprised of, for example, paper, plastic, glass, ceramic, fabric such as canvas, primed canvas, paint-primer treated surfaces, gesso treated surfaces, encaustic gesso treated surfaces, or any other surface configured to receive a deposit of melted crayon, such as a drawn marking via the applicator wand.

A heating and melting element in the melting compartment of the applicator wand may be battery operated or may be operated by electricity conducted via an electric cord from a power outlet through an AC adapter. If battery operated, the applicator wand may include an integrated circuit (IC) and the batteries used may be disposable or rechargeable that could be, for example, recharged in a charging station or simply by plugging in the applicator wand to a USB charger. Batteries that could be used in accordance with aspects herein may include a Li-Poly Battery, for example. The applicator wand may comprise an on and off switch to begin a heating process of the heating and melting element in the melting compartment of the applicator wand, or cooling the heating and melting element of the melting compartment of the applicator wand when not in use. Alternatively, the applicator wand may start heating as soon as it is plugged in for, for example, a corded applicator wand that plugs in to an electric outlet. The applicator wand may further comprise a safety sensor such as a thermal fuse and a thermistor to thermoregulate the applicator wand and thereby prevent overheating of the heating and melting element of the melting compartment. Additionally, the sensor may trigger an auto shut-off when overheating is detected above a first threshold temperature, or when the wand has been in a stationary position for a threshold amount of time (i.e., in a resting state in a stand, without marking on a surface to dispense melted crayon). When excessive heat above a second threshold temperature higher than the first threshold temperature is detected by the thermal fuse, the thermal fuse may break as an additional safety measure. However, when the temperature is below a third threshold temperature lower than the first threshold temperature, the thermistor or thermoregulator sensor may also trigger an automatic power-on feature of the heating elements to heat the melting compartment to start the melting process again. The third threshold temperature may be a minimum temperature required to start the melting process of the solid marking material and the first threshold temperature may be a maximum temperature at which the applicator wand can be safely operated. One or more features of the applicator wand, including the heating element, the heat engine or melting compartment, and the thermistor or thermoregulator sensor may be configured to activate or deactivate one or more features of the applicator wand. For example, the applicator wand may further comprise one or more light emitting diodes (LED) to indicate whether the applicator wand is ready to use or not.

The heating element may be made of a thermal conductor material such as a metal like copper, iron, steel, nickel, chromium, or an alloy such as a nickel-chromium alloy (NiCr), and the like. The heating element may be in the form of a wire that can be wrapped around the heat engine or melting compartment of the applicator wand. The heat engine or melting compartment may therefore be also comprised of a thermal conductor such as aluminum, iron, copper, nickel, chromium, and the like so that when the heating element is heated, the heat generated at the heating element may be transferred to the heat engine or melting compartment. According to aspects, the heating element is fully enclosed within a housing of the applicator wand such that a user may not come into direct contact with the heating element. Heat at a particular temperature range may be applied to the heat engine or melting compartment while the remaining components of the applicator wand may remain cooled (i.e., safe to touch) by having insulative spaces created in the applicator wand housing to distance the heating element from the walls of the applicator wand housing. Nevertheless, while the heating elements are restricted from direct user access, the tip of the applicator wand may be exposed, and therefore, it may be made from a non-conductive material that resists heating and deformation during heating and cooling cycles. For example, the applicator tip and one or more features may be made from a heat-resistant plastic material that resists changes in temperature, therefore not becoming hot to the touch during dispensing of the melted crayon. In one aspect, the melting tip may be a plastic component having non-expansive properties when exposed to particular heating temperatures, such that a dispensing mechanism such as a roller ball tip may be retained within the melting tip in a useable state.

In some embodiments, the temperature at which the heating and melting element is configured to operate may be between 40° C. and 85° C., based on the melting point of the crayon or other pigmented, meltable solid marking material. Therefore, the first threshold temperature referenced above may be 85° C., being the maximum temperature at which the applicator wand may be safely operated, and the third threshold temperature referenced above may be 40° C., being the minimum temperature required for initiating the melting of the crayon or other solid marking material. In accordance with aspects herein, the applicator wand may comprise a temperature dial or setter so that a user may be able to customize the temperature of operation according to the type of solid marking material being used. The temperature setter may include analog, digital, or other temperature controls. The temperature settings may also help regulate flow by for example, providing a lower flow with cooler temperatures by melting the crayon at a slower rate, or providing faster flow with hotter temperatures by melting the crayon at a faster rate. Further, a "smart" temperature controller may also be provided to give the user the ability to set a specific desired temperature within a given threshold with a minimum temperature and a maximum temperature for melting the crayon without jeopardizing the safety of the user.

Exemplary temperature ranges at which the heating element of the applicator wand may be configured to operate may comprise, for example between 40° C. and 64° C., between 43° C. and 66° C., between 50° C. and 68° C., between 50° C. and 75° C., 67° C. and 75° C., and other threshold temperature ranges to produce a fluid marking substance from the crayon or other solid marking material. In accordance with aspects herein, the crayon or other solid marking material may be melted in the heat engine or melting compartment by heat generated by the heating element of the applicator wand upon contact, or after a certain threshold period of exposure time to the heat engine or melting compartment. The melted crayon or other solid marking material may then be collected in a reservoir that may feed an applicator tip of the applicator wand, or may be collected inside of the heat engine. The applicator tip may then be used to distribute the melted crayon onto a receiving surface to create a drawing, design, color pattern, or to apply color onto a pre-drawn sketch, picture, and the like. The receiving surface may comprise any material such as metal, fabric, paper, glass, plastic, rubber, wood, primed substrate, gesso-treated surface, encaustic gesso treated surface, and the like. Additives may be provided to improve or change the properties of the melted crayon or other melted marking material, such as stickiness, to help it stick to the substrate or receiving surface better.

In accordance with aspects herein, the applicator wand may optionally comprise a holding mechanism to retain the crayon above the heating and melting element until ready to use and create markings. Because the crayon is melted prior to application to the receiving medium, the color may be applied in a smooth and even layer of color that is evenly distributed throughout the line or design drawn on the receiving medium. With only a portion of the crayon melted prior to dispensing (i.e., the portion of the crayon passing through the melting compartment), one or more fluid marking characteristics are maintained and overheating of the marking material is prevented. Further, due to the ergonomic and familiar shape of the applicator wand, a user may make familiar strokes such as when using a conventional pen, to create melted-crayon designs of a variety of colors, in a controlled manner. Because the color of markings dispensed by the applicator wand corresponds to the color of melted crayon, segments of multiple different colors of crayon may be sequentially fed into the receiving compartment of the applicator wand to provide multi-color and/or color changing markings. Furthermore, because of the melted application of the crayon on the receiving medium, the colors may appear more vivid and be applied more easily to the receiving medium than when coloring with the crayon itself.

Further, aspects of the applicator wand may allow for the mixing of crayons of different colors and/or compositions inside of the applicator wand itself to allow the creation of designs with unique effects that involve the combination of two or more colors and/or compositions that are melted synchronously or asynchronously together. Some aspects of the invention may include a sequential melting of multiple different colors of crayon segments, which during dispensing by a roller-ball applicator tip, for example, become at least partially blended to create a marbleized marking effect. It is contemplated that other types of tips may also be used in accordance with aspects herein, as will be further described below. In another aspect, a device purging and/or cleaning tool may be provided to remove residual crayon or wax color from the heat engine or melting compartment and/or the applicator tip. For example, one or more cleanup wax sticks or other neutral melting medium suitable for cleaning the applicator wand may be provided. The cleaning medium may be shaped like a crayon and its composition may provide optimal removal of crayon residue, melted crayon residue, combined wax, or other solid marking material used from the inner compartments of the applicator wand, including at least the receiving compartment, the heat engine or melting compartment, and the applicator tip. The cleanup wax stick may include one or more components for cleaning at least a portion of the receiving compartment, heating and melting element, and/or applicator tip. For example, the cleanup wax stick may include a solvent feature that purges residue from melted crayons or other melted marking materials by reactivating any deposited wax within each component and purging the debris via the applicator tip as if producing a melted crayon marking onto a writing surface.

In accordance to additional aspects herein, the applicator wand may comprise different types of applicator tips that may be interchangeable depending on the type of design and effect desired when applying the melted crayon onto the receiving medium. For example, the applicator wand may comprise, for example, a roller tip with a roller ball. The applicator wand may comprise a set of tips with differently sized roller balls to make, for example, lines of different widths and/or dots of different sizes for creating artistic expressions by, for example, stippling or pointillism techniques. Additionally or alternatively, the applicator wand may comprise, for example, valve-system tips used in ink pens, for example, that may be specifically adapted to work with melted crayons or other melting marking materials such as colored wax, and the like. Also, other types of tips may include, for example, an interchangeable felt tip, interchangeable brush tip, interchangeable sponge tip, and the like, for creating different types of textures with the melted crayon. Just like the roller tips described above, the interchangeable valve-system tips, felt tips, interchangeable brush tips, interchangeable sponge tips, and other removable and replaceable tip features may also be provided in different sizes to provide different width coverage when painting or applying the melted crayon or other melted marking material onto the substrate or receiving medium. Further, the tips themselves, whether felt, brush, sponge, valve-system, or roller balls, may comprise a texturized surface to facilitate the delivery of non-melting particles or flakes, or to make a texturized mark on a substrate as the melted crayon or marking material is being delivered from the applicator wand. For example, in a roller ball applicator tip, the roller ball itself may be provided with dimples (e.g., as in a golf ball) or other types of recesses or grooved areas to provide a delivering mechanism for delivering the non-melting particles, flecks, flakes, and the like.

The housing of the applicator wand may be made from an insulative material such as, for example, silicone or other similar material that is not thermally conductive and/or is at least semi-heat resistant. Accordingly, the external shell of the applicator wand may insulate the user from temperature changes in response to the crayon melting process inside the applicator wand, while the dispensing mechanism and/or marking tip may also be made from a non-deformable, insulative material that not only resists temperature changes from the melted wax passing through the applicator tip but retains a dispensing structure so as to continually apply the melted crayon. In some aspects, the material of the applicator tip may depend on the desired marking effect and the particular dispensing feature. Further, a custom stand may be provided to hold the applicator wand in a non-vertical state when the applicator wand is not in use. For example, the custom stand may hold the applicator wand at an angle between 45° and 20° with the applicator tip suspended so that it may be prevented from contacting any surface in order to prevent accidental leakage of the melted crayon or other melted marking material when the applicator wand is not in use. In some aspects, because gravity may cause the melted crayon to travel from the heat engine or melting compartment to the applicator tip, an optimal placement angle may help ensure that the flow of melted crayon or melted marking material is discontinued so that when the applicator wand is in the stand, the applicator wand is in a non-dispensing state.

In one aspect in accordance herein, an applicator wand that comprises a receiving compartment, a heating element, a power source and an applicator tip is provided. In another aspect in accordance herein, a solid marking material melting applicator wand comprising a receiving compartment for receiving and storing the crayon or other solid marking material, a heating element for melting the crayon or other solid marking material, a heat engine, a power source, and an applicator tip is provided. The applicator wand may be configured to work with gravity such that when in a substantially perpendicular orientation with respect to a desired substrate surface, the melted crayon may be able to flow out through the applicator tip only when the applicator tip is in contact with a receiving medium or substrate. In other words, when the applicator tip is not in contact with a receiving medium or substrate, the applicator tip in accordance with aspects herein, may be configured to prevent the melted crayon or liquid coloring medium from exiting the applicator tip, even when the applicator wand is in a substantially perpendicular orientation with respect to the receiving medium or substrate.

In accordance with a different aspect, the applicator wand may be used by opening a lid to access a receiving compartment applicator wand, inserting a crayon or other solid marking material into the receiving compartment, plugging in and/or turning the solid marking material melting applicator wand ON to initiate a heating of a heating element to melt the crayon or other solid marking material into a melted crayon or other melted marking material, and applying the melted crayon or other melted marking material onto a receiving medium using an applicator tip of the applicator wand.

Other features of the applicator wand, in accordance with some aspects herein, may include a rotating head so the user could modify the applicator wand to draw at multiple angles (similar to the writing angle of a pen) rather than only vertical. This would allow a user to use the applicator wand, in accordance to aspects herein, on walls to draw, for example, murals. In order to achieve this, the applicator wand may be further provided with a wax return within the applicator wand so that if the user turns the applicator wand upside down the melted crayon stays within the applicator wand. Once the user rights the applicator wand, the flow of the melted crayon may be returned to the tip for use. Alternatively, a gravity door or one-way valve or a door electronically controlled using a servo actuator may be provided and the applicator wand's orientation may be sensed using an accelerometer or a ball switch.

In a different aspect, the applicator wand may be a closed system having a mechanical way to force the crayon through the applicator wand (i.e., motor, gears, screw, and the like). This would allow mural drawing without spillage using the techniques mentioned previously. In some aspects, the applicator wand may comprise a cartridge system that is loadable from the top (as shown in the figures) or through the side (not shown). The cartridge system would allow a user to quickly swap out colors without having to wait for residual wax or crayon color from a previous crayon to completely exit the applicator wand. In this embodiment, a preheating apparatus may be provided for heating and optionally for shaking the cartridges until they are ready to be used by the user. The applicator wand may be provided with double or triple chambers to let the user insert two or three cartridges of different colors to allow for the dispensing of color blends or custom colors. The cartridges may also be made refillable, where the user would be able to insert pieces of crayons. Then, as described above, the crayon pieces could be melted in the cartridges in a preheating/melting station to liquefy the crayons inside the cartridges. In order to aid in the melting process, additives may be provided that aid in the liquefying of the crayon or other marking material. Other additives that may be included are additives that aid the wax to stick better onto the substrate. The "sticking" additives may be different for different substrates. For example, an additive used for paper may be different from an additive used for glass. In one aspect, the cartridges may be provided with a coat of the additive on the inner wall of the cartridges whether it's clear wax/solubilizer that helps liquefy the melted crayon to the correct consistency or a thickener that would allow the melted crayon to stick better to the substrate of choice. In other aspects, the melted crayon may be configured to solidify on contact with the substrate or shortly after being applied to the substrate. The cartridges may be provided with removeable or dissolvable features that could break away to let the melted wax flow once inserted into the applicator wand.

In accordance with aspects herein, instead of using colored crayons, a user may be allowed to "mix" their own custom color by providing the user with, for example, pigments, colorant pellets, or the like that could be added closer to the tip and clear wax, or paraffin sticks or pellets added through the back. The mixing of the wax or paraffin with the color pigments provided near the tip, may create the custom color which may be directly applied onto a substrate. The mixing may be achieve by, for example, screw mixing, or the applicator tip may be provided with a geared ball, or shaking mechanism to achieve the mixing. Several of the aspects described hereinabove will become more apparent in view of the figures as further discussed below.

Moving on to the figures, FIG. 1 depicts an exemplary applicator wand 100 in accordance with aspects herein. The applicator wand 100 may comprise a power source 110, an ON/OFF switch or release button 120, a housing 150 for securing and enclosing an applicator tip 130, and an optional lid 140 for covering a receiving compartment of the applicator wand 100 (not shown), where a crayon or other solid marking material may be inserted to be melted into a melted crayon or other melted marking material. Other components that may be present may include, for example, a safety sensor 112 such as a temperature regulator. Such safety sensor 112 may include, for example, a thermistor/temperature sensor, and the like. In use, when the applicator tip 130 of the applicator wand 100 is placed in contact with a receiving surface 160, the applicator tip 130 may be configured to leave a mark 170 on the receiving surface 160. The mark 170 comprising the melted crayon or other melted marking material may be made into a design, drawing, art piece, and the like.

Figure 2A:
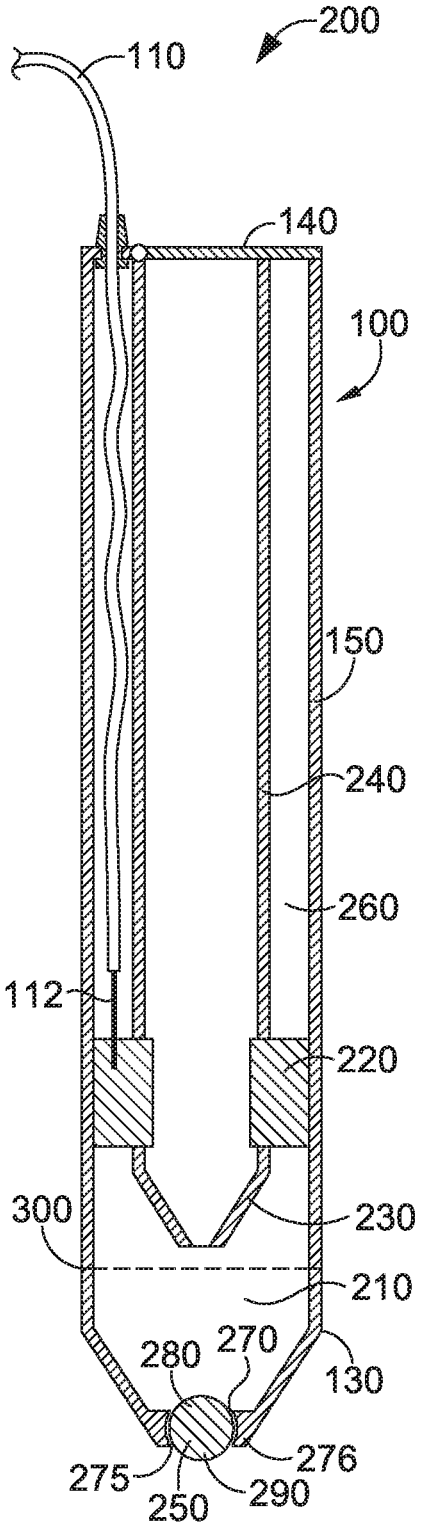
FIG. 2A depicts a cross-sectional view of the applicator wand of FIG. 1 with the lid closed, cut by plane 2A in FIG. 1, in accordance with aspects herein.
Figure 2B:
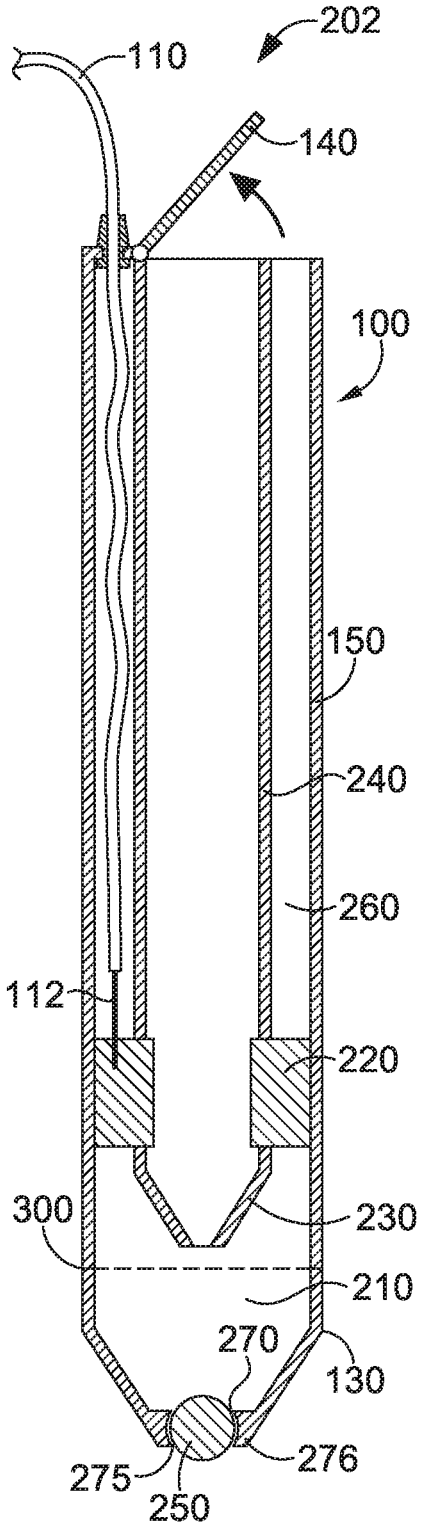
FIG. 2B depicts a cross-sectional view of the applicator wand of FIG. 2A with the lid open, in accordance with aspects herein.

FIGS. 2A and 2B are cross-sectional views 200 and 202, respectively of the applicator wand 100 along the line 2A-2A in FIG. 1. Specifically, FIG. 2A shows the applicator wand 100 with its lid 140 closed and FIG. 2B shows the applicator wand 100 with its lid 140 open. As seen in FIGS. 2A and 2B, the applicator wand 100 comprises a receiving compartment 240 for receiving a crayon or other solid marking material such as a crayon (not shown) and optionally, a reservoir 210 for retaining the crayon or other marking material in its melted form. The crayon or other solid marking material may be melted inside of a heat engine or melting compartment 230, which may be directly in contact with a heating element 220 that connects to a power source 110 or, alternatively, the heating element 220 and the heat engine or melting compartment 230 may be formed as a monolithic piece of equipment. Optionally, the applicator wand 100 may comprise an insulating space 260 between the housing 150 and the receiving compartment 240. The insulating space 260 may be filled with air or an insulating material such as a foam type material, for example, or instead of a space, a thickness of the wall of the housing 150 may be configured to extend through the insulating space 260 and form the receiving compartment 240. When present, the insulating space 260 may be useful in keeping heat from propagating to the external housing 150 so that the housing 150 may remain cool to the touch even when the heating element 220 and the heat engine or melting compartment 230 are active (in other words, in an ON configuration and therefore HOT to the touch).

In the applicator wand 100 shown in the cross-sectional views 200 and 202 of FIGS. 2A and 2B, the applicator tip 130 of the applicator wand 100 comprises a roller ball 250 to form a roller applicator tip 130. In some aspects, the roller ball 250 may be freely rotatable within a cavity 270 of the applicator tip 130, meaning that the roller ball 250 may rotate along at least two axes within the cavity 270 of the applicator tip 130. In other aspects, the roller ball 250 configured to rotate in a clockwise direction or in a counterclockwise direction. According to aspects herein, the free rotation of the roller ball 250 allows at least a portion 280 of the roller ball 250 to be covered or saturated with the melted crayon or other melted marking material and transfer the melted crayon or other melted marking material to a receiving surface when the roller ball 250 is rotated and at least a portion 290 of the roller ball 250 becomes in contact with the receiving surface. The free rotation may also create greater mobility of the roller ball 250 along the receiving surface. As such, in some aspects, a user may paint/write in multiple directions with the roller ball 250 while holding the applicator wand 100 in an upright position with the roller ball 250 contacting a receiving surface or substrate. In other words, the user need not rotate their grip with respect to the applicator wand 100, or angle the applicator wand 100 with respect to a marking surface in order to facilitate contact between the roller ball 250 and the receiving surface or substrate in one or more directions. In other words, to use the applicator wand 100, a user would simply contact the roller ball 250 to a receiving surface, such as, receiving surface 160 shown in FIG. 1 and start guiding the applicator wand 100 to form a desired design. In some aspects, the applicator tip 130 may require priming by allowing a short period of time (e.g. between 1-5 minutes) to allow the crayon or other solid marking material to melt and sufficiently pool in the reservoir 210 so that when a rolling motion of the roller ball 250 is started, melted crayon or other melted marking material is allowed to flow out and onto a receiving surface, only when in contact with the receiving surface.

Further, because there may be different types of crayons or other solid marking materials such as, for example, metallic crayons, glitter crayons, neon crayons and the like, where the meltable carrier contains non-melting particles, flecks, flakes, and the like a gap 275 may be present between the retaining portion 276 and the roller ball 250 of roller applicator tip 130 to allow the passage of the non-melting particles, flecks, flakes, and the like with the melted carrier and onto the receiving surface. In other aspects, the roller ball 250 may itself comprise dimples or other recessed portions on its surface in order to allow passage of non-melting particles, flecks, flakes, and the like, that may be present in the crayons. In some aspects, the non-melting particles, flecks, flakes, and the like may include metallic flakes from, for example, aluminum, copper, silver, brass, or other, or the non-melting particles, flecks, flakes, and the like may include, for example, metallized polymer materials that are dispersed throughout the meltable carrier material, and may comprise different colors to provide different "shine" or glitter/metallic effects, for example.

As briefly described above, the applicator wand 100 may comprise a set of interchangeable tips to be able to create different effects with the melted crayon or other melted marking material. The interchangeable tips may comprise different mechanisms for securing the interchangeable tip to the applicator wand 100, such as, for example, screw on, snap on, twist on, and the like. The dashed line 300 in FIGS. 2A and 2B indicate the points at which the interchangeable tips may be removed and secured on, as needed. Different exemplary interchangeable tips are illustrated in FIGS. 3A to 3F in accordance with aspects herein. For example, the roller balls in roller applicator tips such as roller applicator tip 130 may comprise different diameters to create lines and/or dots (for stippling) having different widths, such as the ones shown in FIGS. 3A-3C, where exemplary roller applicator tips 301, 310, and 320, are shown, respectively. For instance, the roller ball 302 of roller applicator tip 301 may be a medium or standard size for the applicator wand 100 in accordance with aspects herein, configured to make markings with the melted crayon or other melted marking material on a receiving surface having a width that is comparable to the diameter 304 of the roller ball 302. The roller ball 312 of roller applicator tip 310, on the other hand, may be a small size roller ball that is smaller than roller ball 302 (i.e. smaller diameter), and may be configured to make markings on a receiving surface having a narrower width/finer than the roller ball 302 of roller applicator tip 301, such for use in, for example calligraphy type projects where more precision is needed. The roller ball 322 of roller applicator tip 320 may be a big size roller ball that is bigger than roller ball 302 (i.e., bigger diameter), and may be configured to make markings on a receiving surface having a thicker width/fuller than the roller ball 302 of roller applicator tip 301. Further, as shown, the roller applicator tips 301, 310, and 320, comprise a respective gap 306, 314, and 324 between the respective roller balls 302, 312, and 322 and the respective retaining portions 308, 316, and 326 of the roller applicator tips 301, 310, and 320, for allowing the passage of non-melting particles, flecks, flakes, and the like with the melted carrier medium, for example, when using crayons or other solid marking materials such as, glitter crayons, metallic crayons, and the like. Alternatively, the roller balls themselves (not shown) may comprise texturing such as dimples, or other types of recessed portions (e.g., such as in a golf ball), for allowing different texturing on the applied melted crayon or other marking material, or for allowing passage of non-melting particles or flakes that may be present in the crayon or other marking material, such as in metallic crayons, glitter crayons, and the like.

Figure 3A:
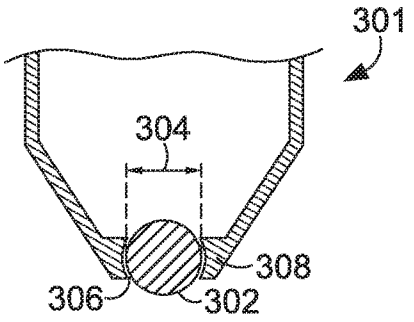
FIGS. 3A-3F depict different types of applicator tips for the applicator wand, in accordance with aspects herein.
Figure 3B:
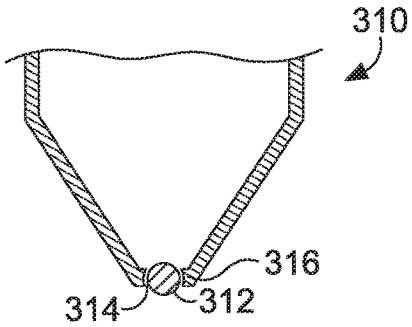
Figure 3C:
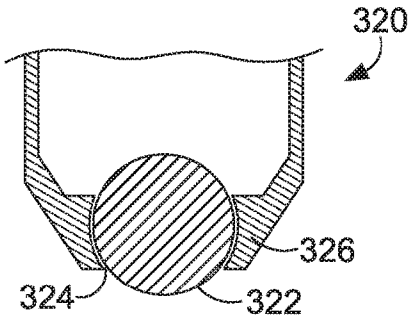
Figure 3D:
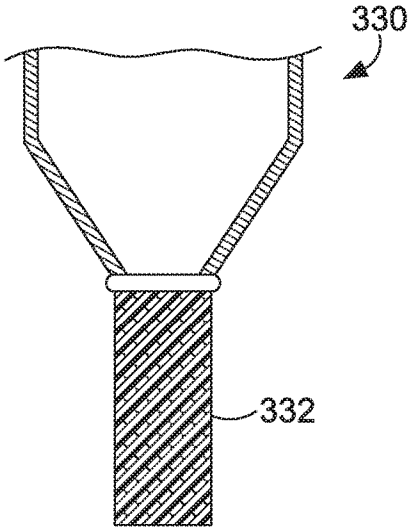
Figure 3E:
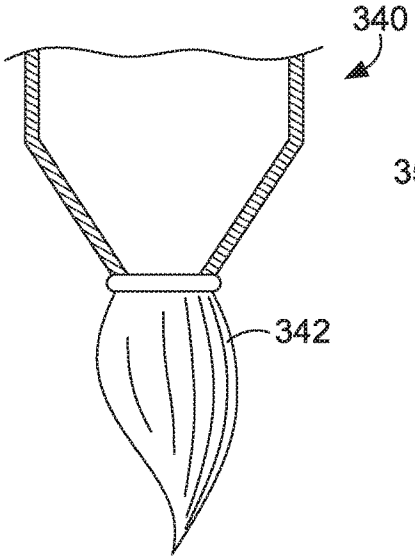
Figure 3F:
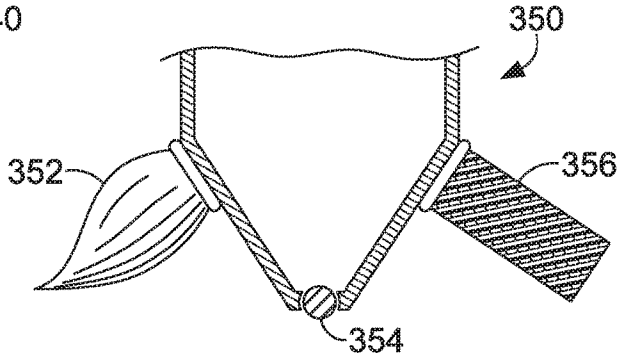

Furthermore, as also briefly described above, different types of applicator tips other than roller applicators may be used in accordance with aspects herein. For example, FIG. 3D depicts an applicator tip 330 with a tip 332 that can be either a felt tip or sponge tip. The applicator tip 330 may be allowed to become soaked with the melted crayon or other melted marking material prior to the start of application onto a receiving medium. Because of the different texture of the tip 332 compared to the roller applicator tips, different effects may be created on the receiving surface as the melted crayon or other melted marking material is being applied. Although not shown in the figures, the applicator tip 330, similar to the roller applicator tips 301, 310, and 320, may comprise tips similar to tip 332 that comprise different sizes (small, medium, large), different shapes (cylindrical, square, rectangular, angled, star, oval, pointed, non-pointed, and the like), different textures (smooth, rough, even, uneven, and the like), and the like. Further, FIG. 3E depicts yet a different exemplary applicator tip 340 comprising a brush tip 342. The brush tip 342 may also be varied in size, softness, fullness, and the like. In a different aspect, it is also envisioned that a single applicator tip may comprise different types of tips such as the applicator tip 350 shown in FIG. 3F where the applicator tip 350 comprises a brush tip 352, a roller tip 354, and a felt or sponge tip 356 in one. It is in accordance with aspects herein that any combination of tips may be provided, and as described briefly above, the applicator tips may be made to be interchangeable to suit the different needs of a user when using the applicator wand 100, as described above, to design or create a piece of art work, such as for example, encaustic artwork.

Figure 19A:
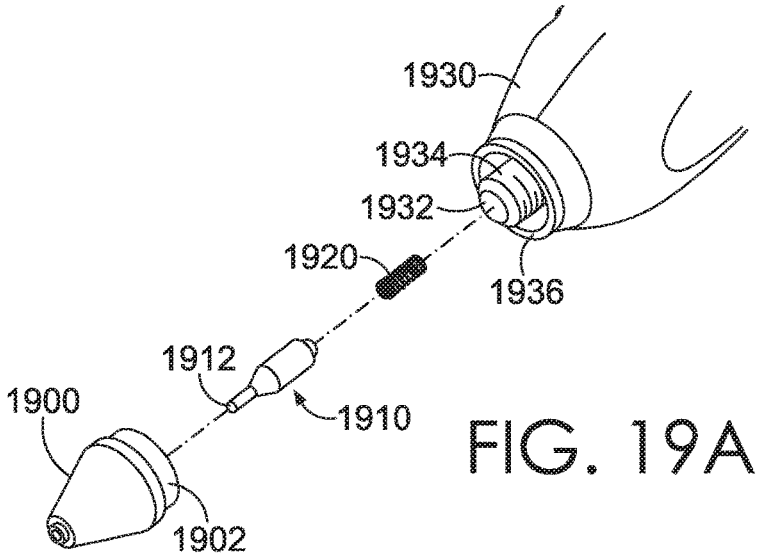
FIG. 19A depicts an applicator wand tip with a pin-style valved system tip in accordance with aspects herein.
Figure 19B:
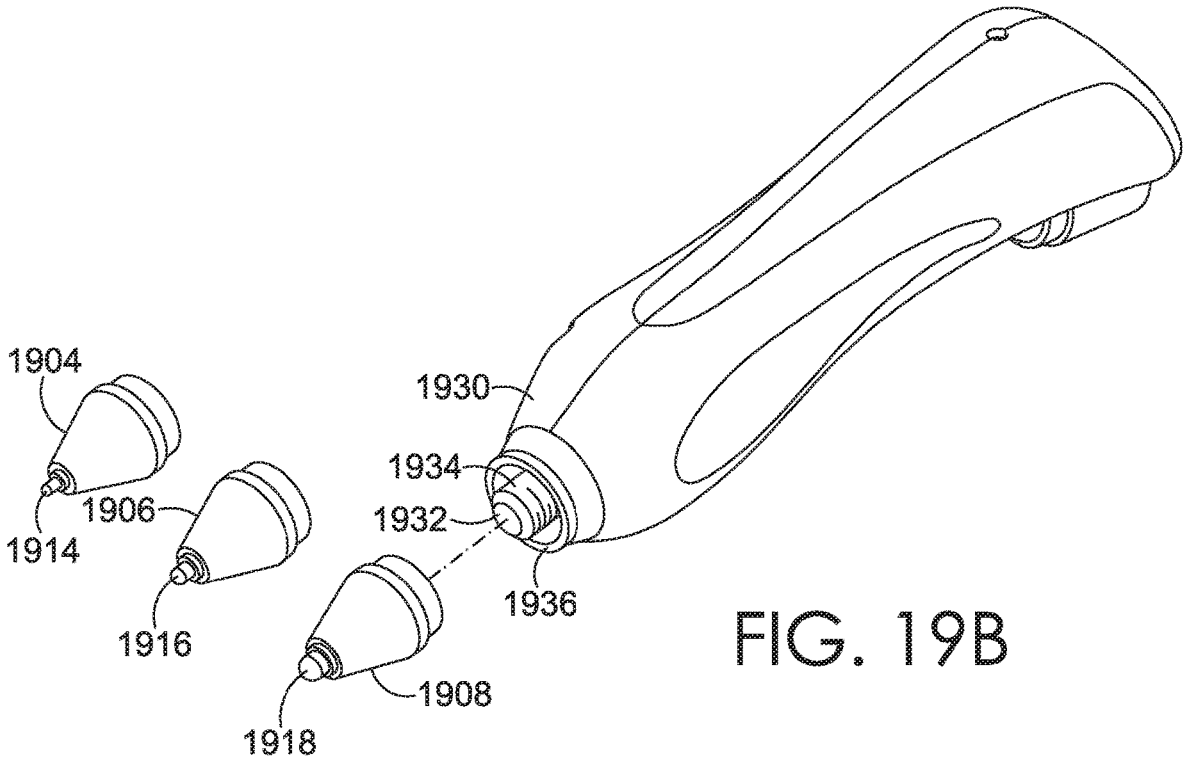
FIG. 19B depicts an applicator wand with interchangeable tips in a pen type tip.

Furthermore, pin-style valved system tips may be provided such as the ones shown in FIGS. 19A and 19B for fine writing, weight-wire/hollow tube style tips for ultra-fine writing, and the like. As shown in FIG. 19A, the pin-style valved system tips may comprise at a high level, a tip housing 1900 having a neck portion 1902 for connection to the applicator wand housing 1930 via the lip portion 1936 that can be a screw type connection, a snap connection, a twist connection, and the like. The housing portion 1930 may further comprise a collar 1934 with an opening 1920 for receiving a spring 1920 and a pin 1910. The pin 1910 may comprise a writing portion 1912 that may determine the thickness of the writing surface of the tip. For example, FIG. 19B depicts an applicator wand with three different exchangeable tips 1904, 1906, and 1908, each having a writing portion with a different thickness (i.e., a fine writing portion 1914 for tip 1904, a medium writing portion 1916 for tip 1906, and a thick writing portion 1918 for tip 1908. In the pin-style valved system tips described above, the pin 1910 acts as a valve with the help of the spring 1920. When a user applies pressure when using the applicator wand, the pin 1910 pushes back in to the collar 1934 allowing the melted crayon or other melted marking material to flow around the pin 1910. As the melted crayon or other melted marking material flows down onto the outer surface of the pin 1910, the melted crayon or other melted marking material is deposited onto the receiving surface or substrate. When the applicator wand is not in use, the pin 1910 will be pushed by the spring 1920 against the tip housing 1900 to stop flow by sealing any gaps in the tip housing 1900. Further, the core structure for the applicator wand may be provided with a retaining mechanism that allows it to retain melted wax during tip exchange. For example, a thermo-regulator may be provided to have delay sensor for acclimating the melted wax with the new tip, so that dispensing is delayed until any air bubbles are dissipated or any filling in of the new tip with wax has "settled." As well, the applicator wand may be provided with a Peltier device for fast cooling when the applicator wand is not in use or it is ready to be stored.

Figure 20A:
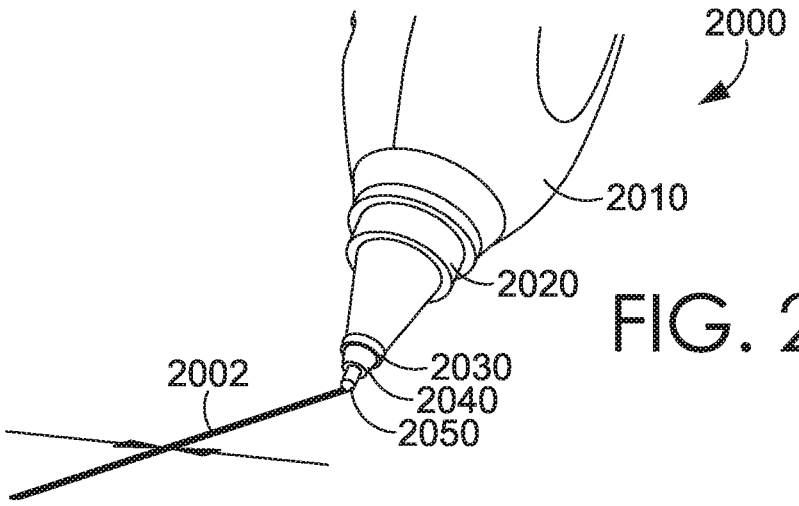
FIG. 20A-20C depict an applicator wand with a twistable or slide tip configured to expose different tip widths.
Figure 20B:
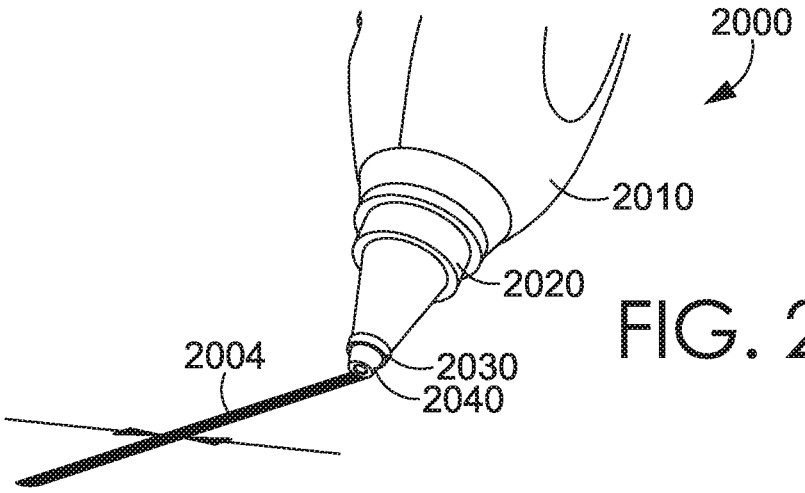
Figure 20C:
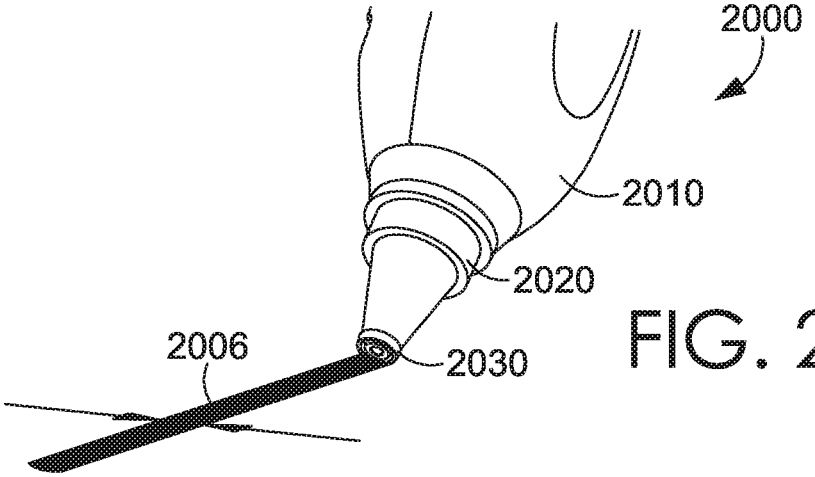

Different tip designs may be optimized to work on different surfaces or, a single tip 2020 that may offer multiple writing features such as the exemplary applicator wand 2000 shown in FIGS. 20A to 20C. As shown, tip 2020 may be affixed to the housing 2010 of the applicator wand 2000. The tip 2020 may comprise multiple writing portion 2030, 2040, and 2050. The tip 2020 may be operated with a twist or slide action to expose a desired writing portion depending for example, on the area that a user would like to cover in one stroke of the applicator wand. For example, if the user wants a fine line such as line 2002, the user may set the tip 2020 to expose the fine writing portion 2050, as shown in FIG. 20A. If the user wants a medium line such as line 2004, the user may set the tip 2020 to expose the medium writing portion 2040, as shown in FIG. 20B, and if the user wants to make a thick line, such as line 2006 to cover the greatest amount of surface area in one stroke, the user may set the tip 2020 to expose the thick writing portion 2030, as shown in FIG. 20C. This configuration may have a pin-style valved system similar to the one described above, with the twist or slide action on the tip 2020 allowing more or less of the pin to be exposed to the receiving surface or substrate. Thus, the thickness and fullness of the markings may be varied depending on the size of the applicator tip's delivery medium (e.g., roller ball, brush, felt or foam, and the like). As well, since the melted crayon or other melted marking material solidifies after it has been applied to a receiving surface the applicator wands in accordance with aspects herein, may be used to create three dimensional (3D) effects on the receiving surface by applying melted crayon or other melted marking material on top of a solidified crayon or other melted marking material that has been previously applied.

Figure 21A:
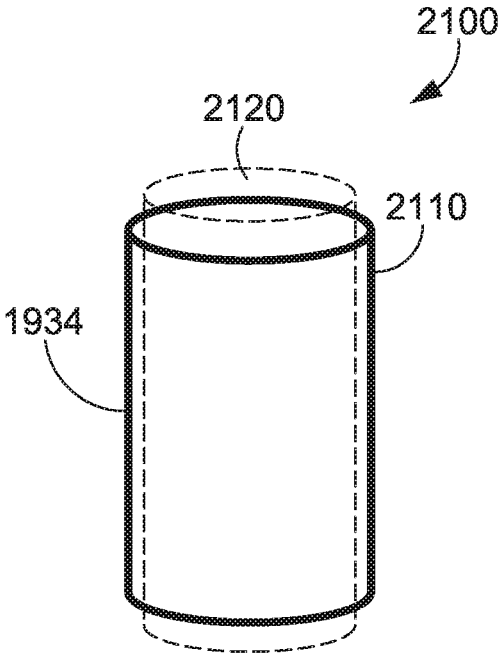
FIGS. 21A and 21B depict different views of a nib for yet another tip type for the applicator wand in accordance with aspects herein.
Figure 21B:
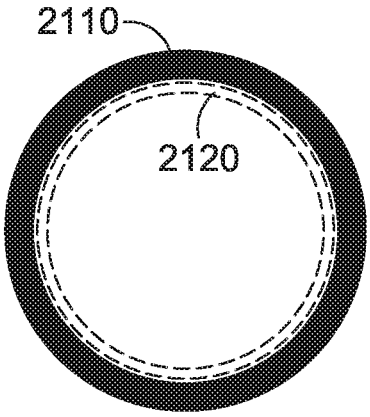

Yet another type of tip may comprise a nib 2100 having a tubular configuration as shown in FIGS. 21A and 21B with an inner nib 2120 and an outer nib 2110, where the outer nib 2110 is configured to wrap around inner nib 2120 and the inner nib 2120 is configured to extend beyond the outer nib 2110, as shown in the upright view in both perspective views of FIGS. 21A and 21B. Both the inner nib 2120 and the outer nib 2110 may be comprised of a metal material for allowing thermal conduction to allow it to stay warm during use of the applicator wand. As the inner nib 2120 is depressed against a substrate by a user, the pressure may cause a valve (not shown) to open up to allow melted crayon or other marking material to flow. When pressure is released, the inner nib 2120 may be returned to its initial state, causing the valve to close and therefore stop the flow of melted crayon or other melted marking material.

In accordance with further aspects herein, the roller balls, the pins, or the nibs, and other tip components may include a coating treatment such as Teflon® and the like, to prevent melted crayon or other melted marking material from sticking onto the surface of the roller balls, the pins, or the nibs, and other tip components when they are used. Further, the tips may be provided with LED(s) that interact with the wax in different ways to create a photochromic effect. Furthermore, the tips in accordance with aspects herein may be comprised of non-heat conductive materials such as plastics, wood, and the like, so that even if the tip comes in contact with a user, the tip will be safe to touch a user's skin without causing burning. Additional elements that could be included in the tip may be sensors so that the applicator wand may be triggered to dispense or not dispense based on pressure, position, holding angle, and the like. Furthermore, the tips may also be provided with a capacitive sensor at the tip that senses touch with the receiving surface or substrate, which would cause the tip to begin permitting flow of melted crayon or other melted marking material, and stop flow once the capacitive sensor no longer senses contact with the receiving surface. Other ways to dispense or not dispense melted crayon or other melted marking material may be based on pressure, position, holding angle, an on off button, a squeeze or trigger mechanism, and the like.

Figure 4A:
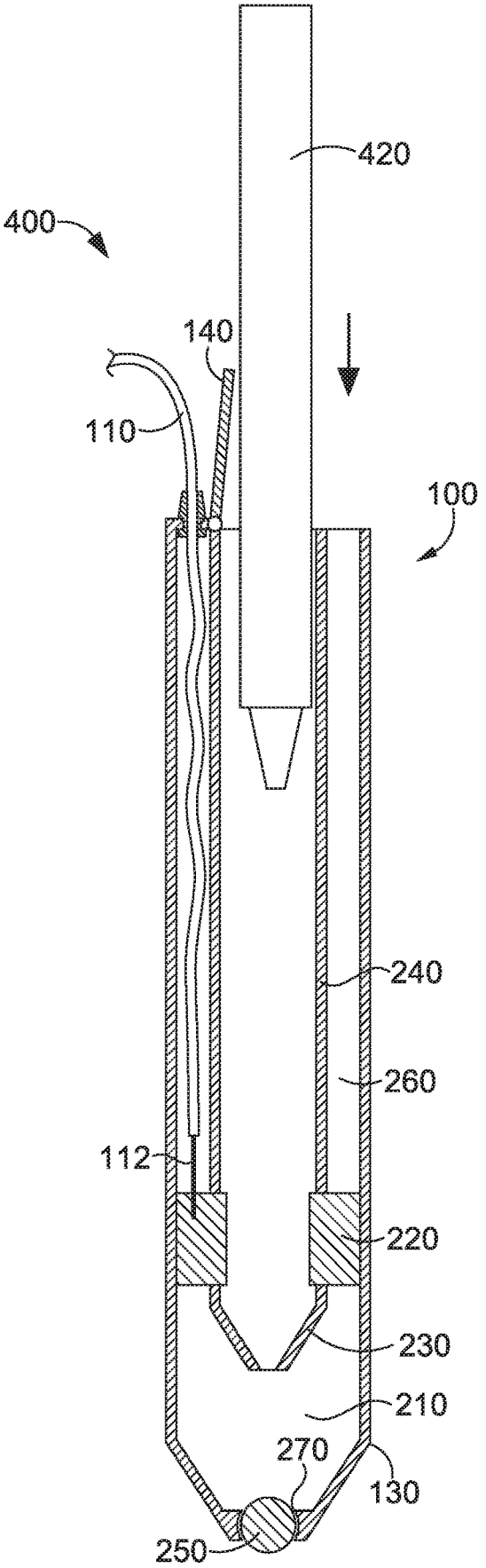
FIG. 4A depicts a cross-sectional view of the applicator wand in FIGS. 2A and 2B showing how a solid marking material may be inserted into a receiving compartment of the applicator wand, in accordance with aspects herein.
Figure 4B:
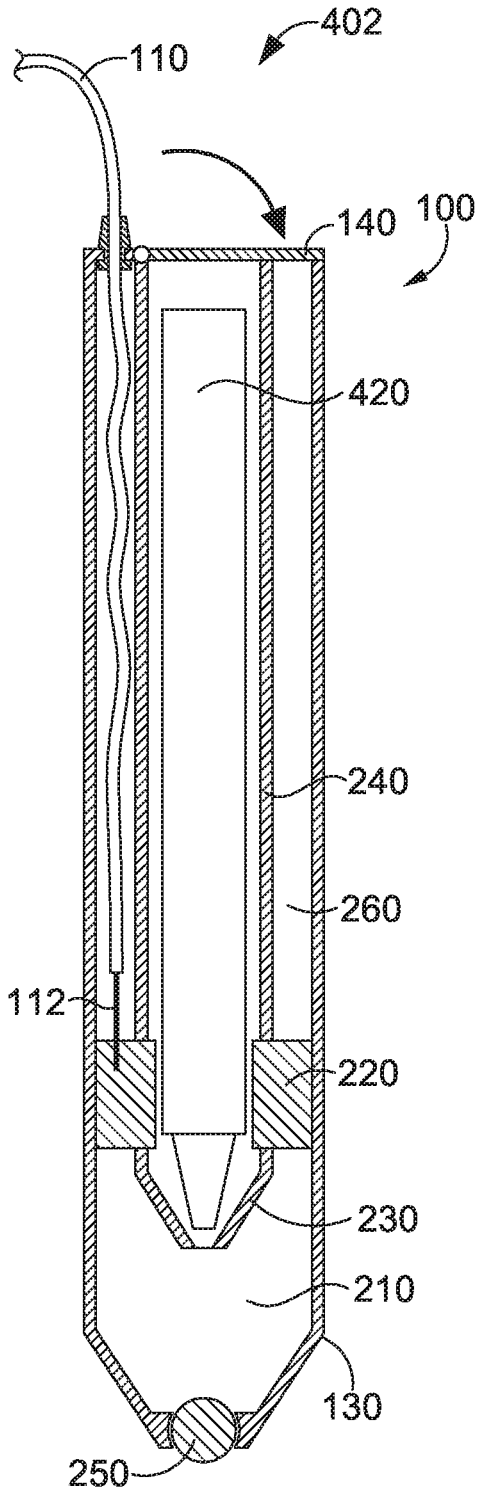
FIG. 4B depicts a cross-sectional view of the applicator wand in FIG. 4A with the solid marking material fully inserted into the receiving compartment of the applicator wand, in accordance with aspects herein.
Figure 4C:
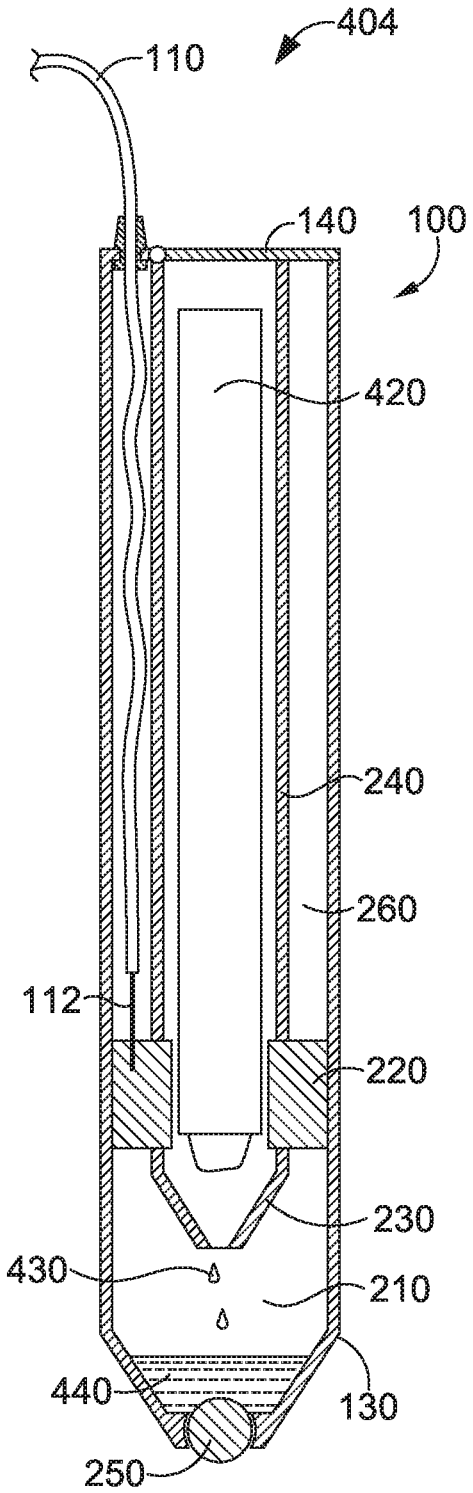
FIG. 4C depicts a cross-sectional view of the applicator wand in FIG. 4B with the solid marking material being melted and collected into a reservoir, waiting to be applied by an applicator tip of the applicator wand, in accordance with aspects herein.

Moving on to FIG. 4A to FIG. 4C, FIGS. 4A to 4C show how the applicator wand 100 works to melt a solid crayon 420. FIG. 4A depicts the first step 400 where the crayon 420 is inserted into the receiving compartment 240 by opening the lid 140 of the applicator wand 100. Once the crayon is inserted into the receiving compartment 240, as shown in FIG. 4B, the lid 140 may be closed and the applicator wand 100 may be set to ON to turn the heat up on heating element 220 and heat engine or melting compartment 230. The applicator wand 100 may be set to ON by either plugging the wand's electric cord into an electric outlet or other source of electricity, or, the applicator wand 100 may be provided with an ON/OFF switch and/or a battery compartment to power the heating element 220 and the heat engine or melting compartment 230.

Once the heating element 220 and the heat engine or melting compartment 230 are sufficiently heated, the melting process of the crayon 420 may be started and at least a portion of crayon 420 may be melted in heat engine or melting compartment 230. The non-melted portions of the crayon 420 may automatically fall into the heat engine or melting compartment 230 by the pull of gravity, as portions of the crayon 420 become melted. The melted crayon 430 may be collected into a pool 440 from which it may be released as the applicator tip 130 is activated to release the melted crayon 430 onto a receiving surface by, for example, starting a rotating motion of the roller ball 250. In the example shown in FIGS. 4A-4C, the applicator tip 130 comprises the roller ball 250 that is configured to release the melted crayon 430 from the pool 440 as the roller ball 250 is rolled onto the receiving surface, as shown in FIG. 1. In accordance with further aspects herein, cleaning "crayons" or wax sticks may be provided that are especially formulated to clean any residual crayon 420 from the inner components of the applicator wand 100 for maintenance and storage. The cleaning wax sticks may be melted in the same manner as a crayon 420, and the melted cleaning formulation may be allowed to flow out of the applicator wand 100 in the same manner as when applying the melted crayon 430 onto a receiving surface.

Figure 5A:
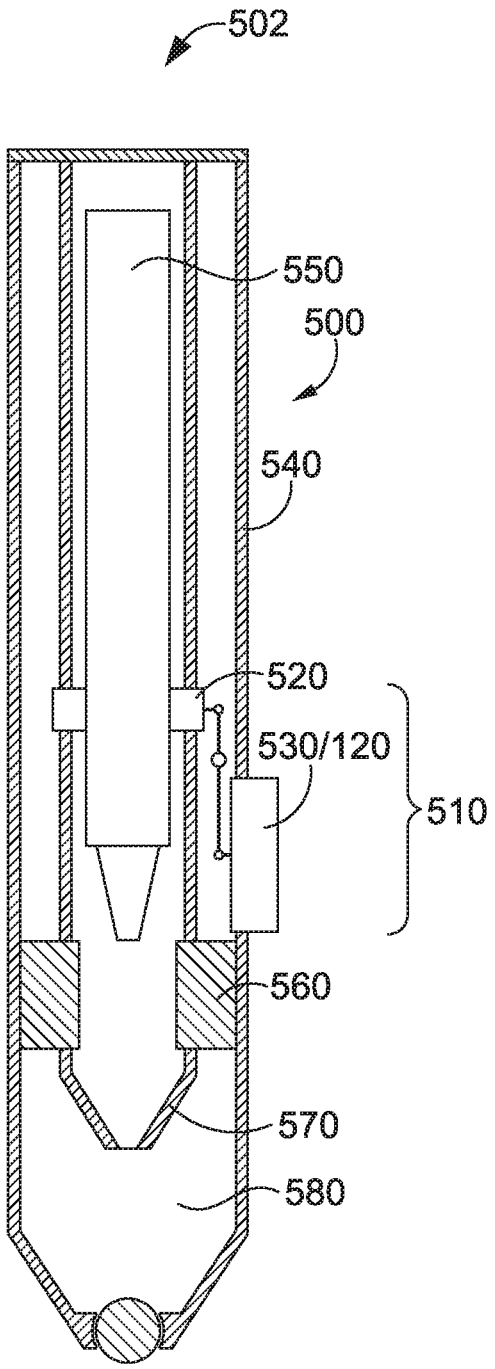
FIGS. 5A and 5B depict cross-sectional views of the applicator wand in FIG. 1 with the lid closed, cut by plane 5A in FIG. 1 to show an optional holding mechanism configured to hold and release the solid marking material inside the receiving compartment of the applicator wand, in accordance with aspects herein.
Figure 5B:
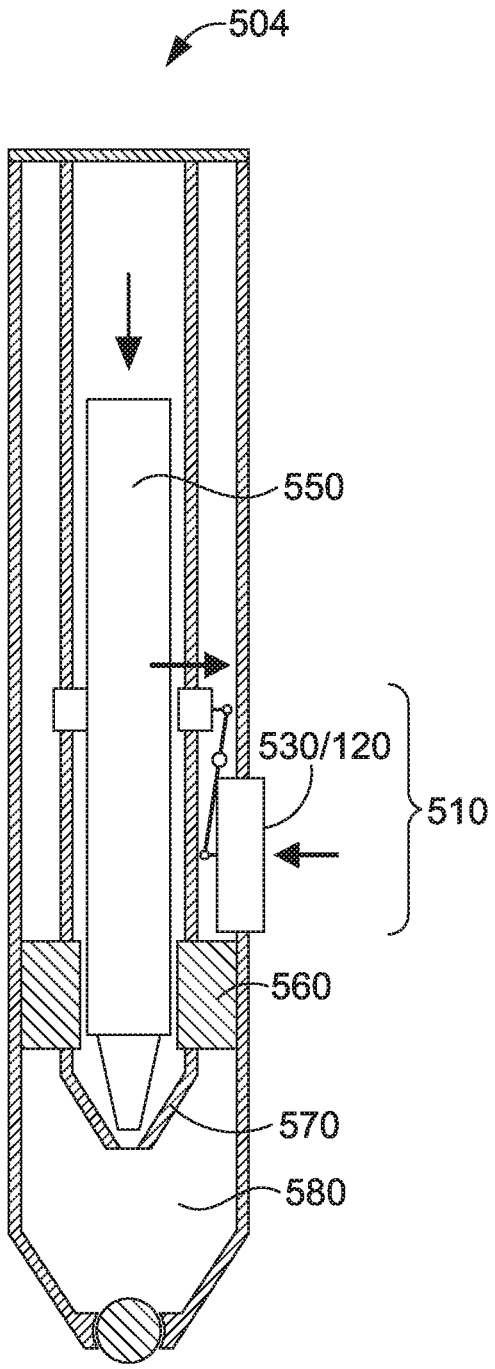

FIGS. 5A and 5B depict a cross-sectional view of an alternative applicator wand 500 further comprising a hold/release mechanism 510 comprising at least a button 530 protruding from an external casing 540 that when in a rest position (not pressed) is configured to hold a crayon 550 above a heating element 560 and a melting element 570 via, for example, a mechanism 520. Vice versa, when the button 530 is pressed, it is configured to, for example, release the crayon 550 so that it drops by, for example, gravity, into the heating element 560 and melting element 570 to start the melting process of the crayon 550. The hold/release mechanism, may be configured to automatically return to its rest position when the button 530 is not pressed, thereby holding any non-melted portions of the crayon 550 above the heating element 560 and heat engine or melting compartment 570. This hold/release button may allow the user to control flow and the rate at which the crayon 550 is melted, thereby controlling an amount of melted crayon gathered in reservoir 580 to prevent overflow, leakage, and/or waste by melting more of the crayon 550 than desired for a particular project or color. For example, a user may choose to melt only a chosen amount of a particular color of crayon. The user my choose to melt the amount desired of crayon 550 while holding any non-melted portions above the heating element 560 and heat engine or melting compartment 570. Then, the user may remove the unused portion of crayon 550 and replace it with a different crayon 550, to allow for a quick, mess free exchange of colors, for example, or to allow a user to melt different colors and allow them to mix in the reservoir 580 prior to applying the melted crayon 550 onto a receiving surface.

Figure 6:
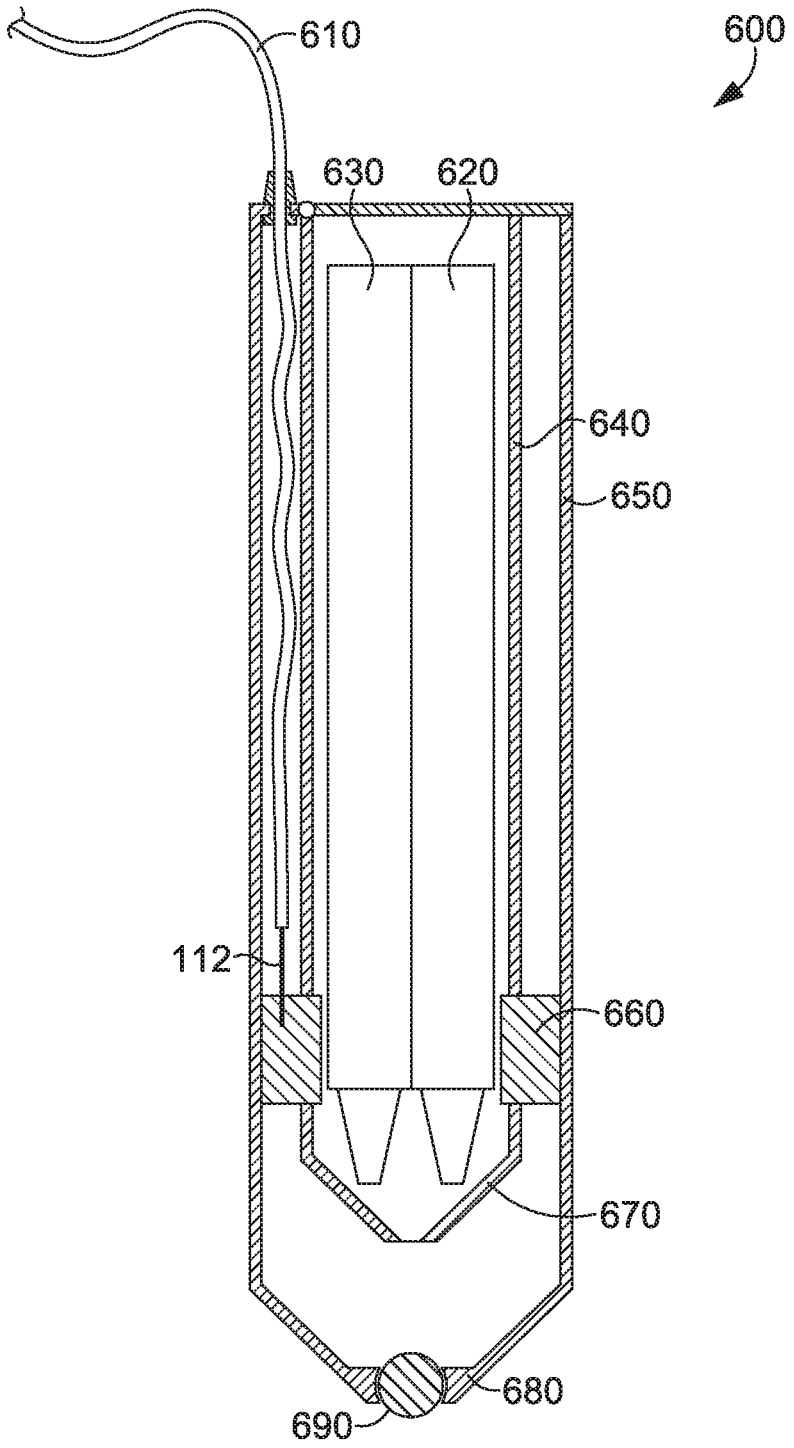
FIG. 6 depicts a cross-sectional view of an applicator wand with a receiving compartment capable of receiving one or more solid marking materials simultaneously, in accordance with aspects herein.

FIG. 6 depicts an applicator wand 600 that is similarly constructed to applicator wand 100 with an energy source 610, a receiving compartment 640, a heating element 660, a heat engine or melting compartment 670, an external casing 650, an applicator tip 680, and a tip 690. The applicator wand 600 may be able to receive one or more crayons or other solid marking materials. For example, the applicator wand 600 depicted in FIG. 6 comprises a receiving compartment 640 that is configured to receive two crayons 630 and 620 simultaneously. The ability of the receiving compartment to receive more than one crayon allows a user of the applicator wand 600 to create unique effects by, for example, being able to melt two different colored crayons simultaneously. As well, because of the increased holding capacity of the receiving compartment 640, the need to refill the compartment may be greatly reduced.

Figure 7:
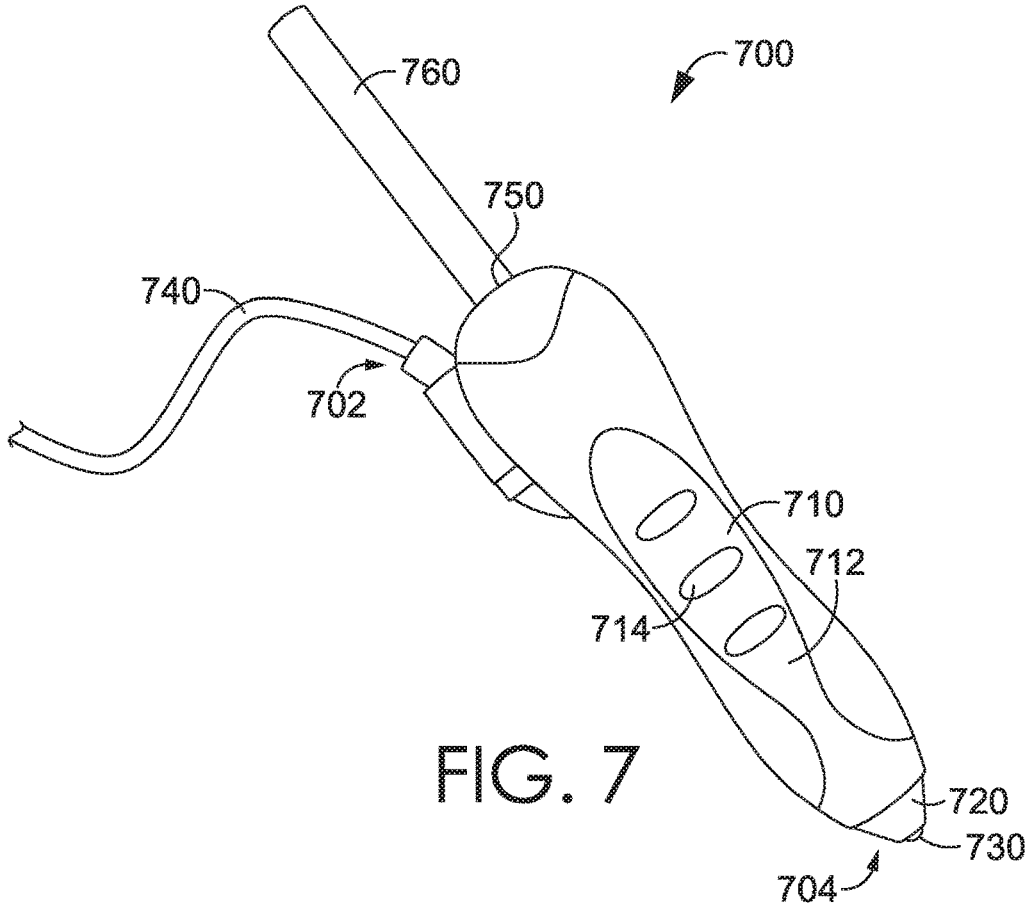
FIG. 7 depicts a different exemplary applicator wand in accordance with aspects herein.

FIG. 7 depicts another exemplary applicator wand 700 in accordance with aspects herein. As shown, the applicator wand 700 may comprise an ergonomic grip portion 710 to provide a comfortable grip for a user of the applicator wand 700, particularly when using the applicator wand 700 for prolonged periods of time. As well, the ergonomic grip portion 710 may be coated with one or more materials such as rubber, synthetic rubber or other like material at portion 712, or a cushioning pad 714 may be included that may be comprised of, for example, foam, memory foam or other shape memory polymer that is configured to conform to the grip of the user when the applicator wand 700 is in use and return to its original shape when not in use. The combination of the materials used at portion 712 and cushioning pad 714 at ergonomic grip portion 710 may allow the applicator wand 700 to comfortably fit into the hands of a user and increase friction (i.e., make it less slippery) between the hand of the user and the applicator wand 700, regardless of a size of the user's hand.

The applicator wand 700 in FIG. 7, may further comprise a first end 702 and a second end 704, where an opening 750 for receiving a crayon or other solid marking material 760 may be located proximal to the first end 702, and an applicator tip 720 may be located proximal to the second end 704. In accordance with aspects herein, the applicator tip 720 may be, for example, a roller applicator having a roller ball 730, or any of the applicator tips shown in FIGS. 3A-3F. The first end 702 may further comprise an outlet for a power cord 740, configured to power a heating and melting element (not shown) of the applicator wand 700.

Figure 8:
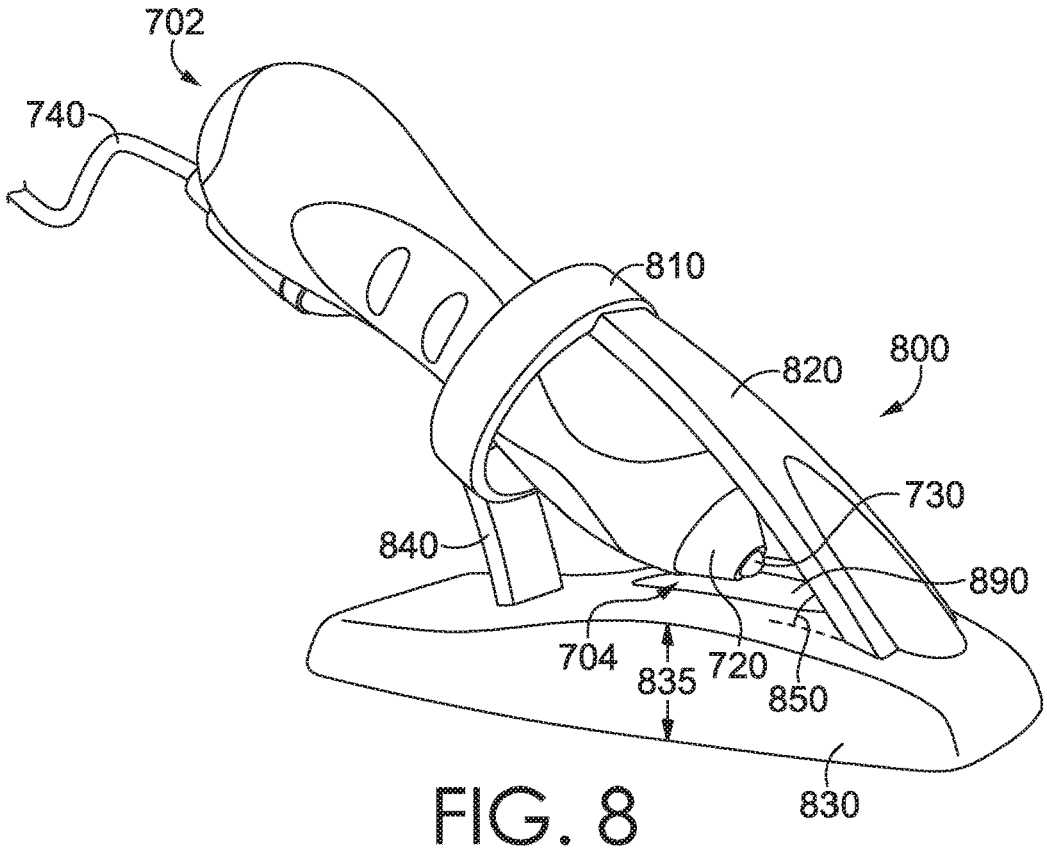
FIG. 8 depicts the exemplary applicator wand in FIG. 7 with a stand, in accordance with aspects herein.

FIG. 8 shows an applicator wand stand 800 for an applicator wand such as applicator wand 700 in accordance with aspects herein. The applicator wand stand 800 may comprise at least a holder portion 810, a front stand portion 820, and a base portion 830. The front stand portion 820 may be configured to angle the holder portion 810 at an angle 850 that is offset from an orthogonal orientation relative to the base portion 830. The angle 850 is important because it is configured to prevent the crayon or other solid marking material 760 (shown in FIG. 7) from "falling" into a heating and melting element(s) (not shown) of the applicator wand 700 by, for example, reducing a gravitational pull on the crayon or other solid marking material 760 when the applicator wand 700 is not in use. The applicator wand stand 800 may further comprise a rear stand portion 840, for added support for the holder portion 810, so that the holder portion 810 may have an increased stability to securely stow the applicator wand 700 at the prescribed angle 850.

When in use, the holder portion 810 of the applicator wand stand 800 may be configured to wrap around at least a portion of the circumference of the applicator wand 700, for example, and the front stand portion 820 of the applicator wand stand 800 may be configured to act as a stop so that the applicator wand 700 slides into the holder portion 810 for a predetermined distance that prevents the applicator tip 720 from touching any surface, thereby preventing any inadvertent leakage from the applicator wand 700. In other aspects, the base portion 830 of the applicator wand stand 800 may have a height 835 and a voided portion 890 for accommodating applicator tip 720 of applicator wand 700, in order to prevent the applicator tip 720 from touching any surface while the applicator wand 700 is in the applicator wand stand 800.

Figure 9:
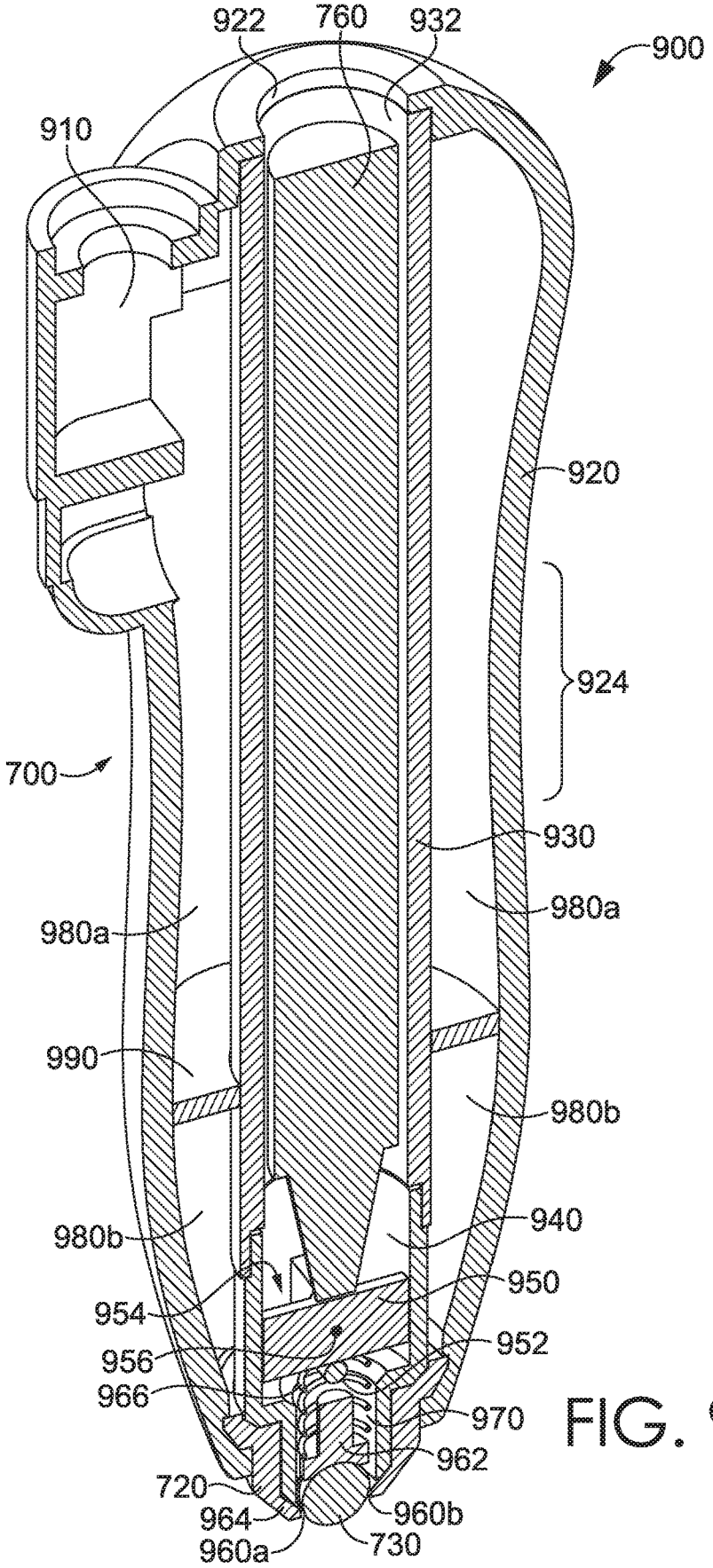
FIG. 9 depicts a cross-sectional perspective view of the applicator wand in FIG. 7, in accordance with aspects herein.

FIG. 9 depicts a cross-sectional perspective view 900 of applicator wand 700, in accordance with aspects herein. As shown, the crayon or other solid marking material 760 (e.g., a crayon) may be inserted into an interior cavity 932 through opening 922. The crayon or other solid marking material 760 may fall into the interior cavity 932 by for example, a gravitational pull, when the applicator wand 700 is in a substantially upright orientation. As shown, the applicator wand 700 may comprise an interior shell 930 configured to hold the crayon or other solid marking material 760 in place, and an exterior shell 920, configured to wrap around the interior shell 930 and provide the ergonomic shape to the applicator wand 700. The exterior shell may also define a power source cavity 910, in which a power source, such as a power cord, may be securely accommodated. As described above, at least the interior shell 930 may be comprised of a heat-conductive material such as heat conductive metals, for example, aluminum, copper, iron, and the like. The exterior shell 920 may be comprised of a material that does not conduct heat such as, for example, hard plastics, wood, or mixtures thereof that may form a non-thermally conductive shell. A grip portion 924 may optionally, further comprise, for example, a rubber coating and/or a foam coating, and/or discrete rubber or foam pads for comfort and to create a frictional surface to improve grip (make the grip portion 924 substantially non-slippery). A stabilizer portion 990 may be provided between the interior shell 930 and the exterior shell 920 to further secure the interior shell 930 in place, thereby ensuring the presence of an insulating space 980*a* and 980*b* between the interior shell 930 and the exterior shell 920. The insulating space 980*a* and 980*b* may be an empty space (i.e., only air present), or, the insulating space 980*a* and 980*b* may be filled with an insulative material such as, for example, foam, in order to further prevent the thermal conduction generated in a heating chamber 940 of the applicator wand 700.

The heating chamber 940 may comprise a melting element 950, which may be configured to melt the crayon or other solid marking material 760 upon contact with the crayon or other solid marking material 760. The melting element 950 may be shaped such that it is able to retain the non-melted portions of the crayon or other solid marking material 760 above the heating chamber 940 and melt only the portions of the crayon or other solid marking material 760 that come in contact with the melting element 950. In FIG. 9, for example, the melting element is shown as comprising an "x" shape, where the crossing point 956, for example, serves to retain the crayon or other solid marking material 760 and melt the contacting surface of the crayon or other solid marking material 760, while the openings 954 serve to allow a melted crayon or other melted marking material to slide down (i.e., drip down) into a pooling chamber 970, which may be configured to retain the melted crayon or other melted marking material until the applicator tip 720 of the applicator wand 700 is activated by, for example, rolling (when the applicator tip is a roller ball applicator, as shown) the roller ball 730 on a receiving surface. The melting element 950 may be retained in place by, for example, a retainer component 952 and the roller ball 730, may be retained and secured in place by, for example, roller ball securing component 962.

Optionally, the roller ball securing component 962 may comprise a spring 966 (as shown in FIG. 9). The spring 966 may be configured to act as a pressure-dependent flow control mechanism. For example, the spring 966 may cause the roller ball tip 720 to be spring loaded. When the spring 966 is in its rest (i.e., extended) state, the spring may be configured to apply pressure (i.e., push) outward, thereby pushing the roller ball securing component 962 and the roller ball 730 outward, causing one of or both of the roller ball securing component 962 and the roller ball 730 to engage with a perimeter of the retaining portion 964 to restrict flow of melted crayon or other melted marking material out of the applicator tip 720, when not in use. When in use, flow of the melted crayon or other melted marking material may be started by the user applying a downward pressure to the applicator wand 700, which would cause the spring 966 to contract and push the roller ball securing component 962 and the roller ball 730 inward, causing the roller ball 730 and/or the roller ball securing component 962 to disengage from the perimeter of the retaining portion 964. In other aspects, the spring 966 may be used for aiding in the exchanging of applicator tips, when interchangeable tips are provided (e.g., spring loaded tip on/tip off mechanism). It is contemplated that the spring 966 may be useful in these and other types of flow control or other mechanisms without departing from aspects herein.

As briefly described above, in the cases where the applicator tip 720 is a roller tip, a gap 960*a* and 960*b* may be provided between the roller ball 730 and a retaining portion 964 of the applicator tip 720 around the perimeter of the retaining portion 964. The gap 960*a* and 960*b* may allow flow of any non-melting particles, flecks, flakes, and the like that may be present in the crayon or other solid marking material 760, for example, when the crayon or other solid marking material is a metallic or glitter crayon or other. Additionally or optionally, the roller ball 730 itself may be provided with dimples (e.g., as in a golf ball) or other types of recesses or grooved areas (not shown) to provide a delivering mechanism for delivering the non-melting particles, flecks, flakes, and the like.

Figure 10:
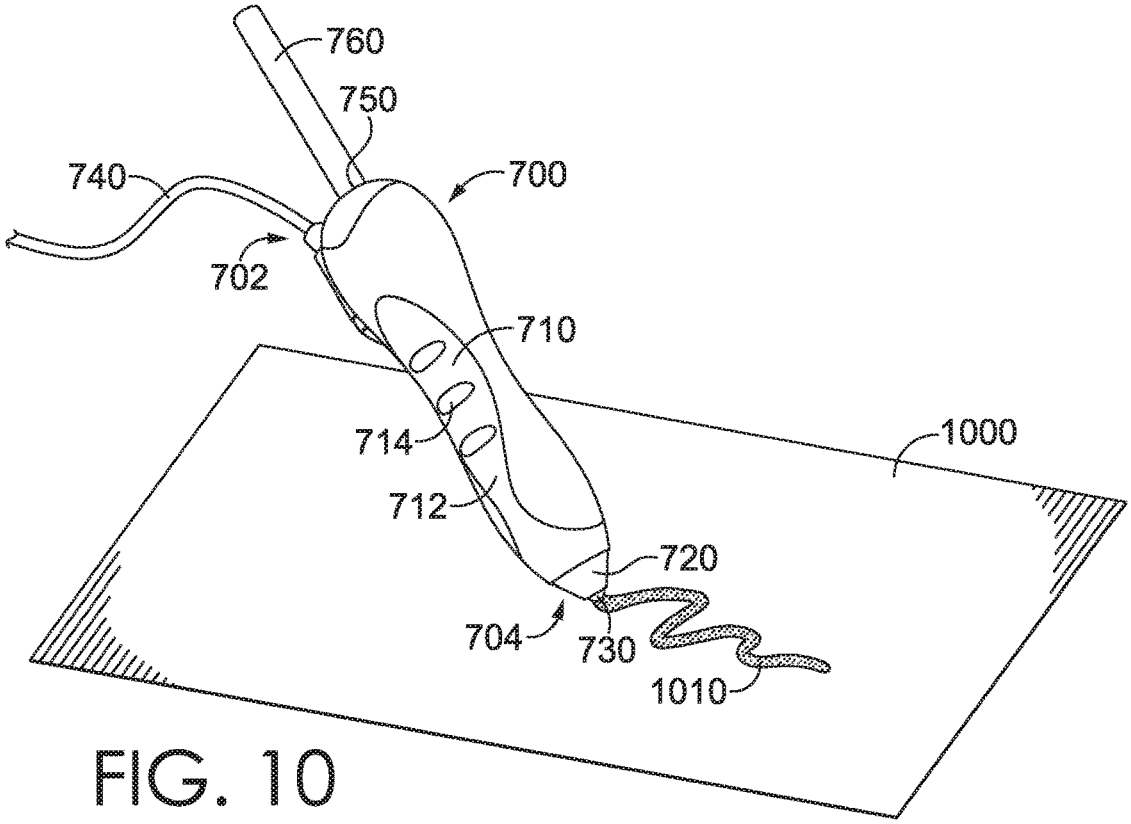
FIG. 10 depicts the applicator wand in FIG. 7 as used for making a continuous marking on a receiving medium, in accordance with aspects herein.
Figure 11:
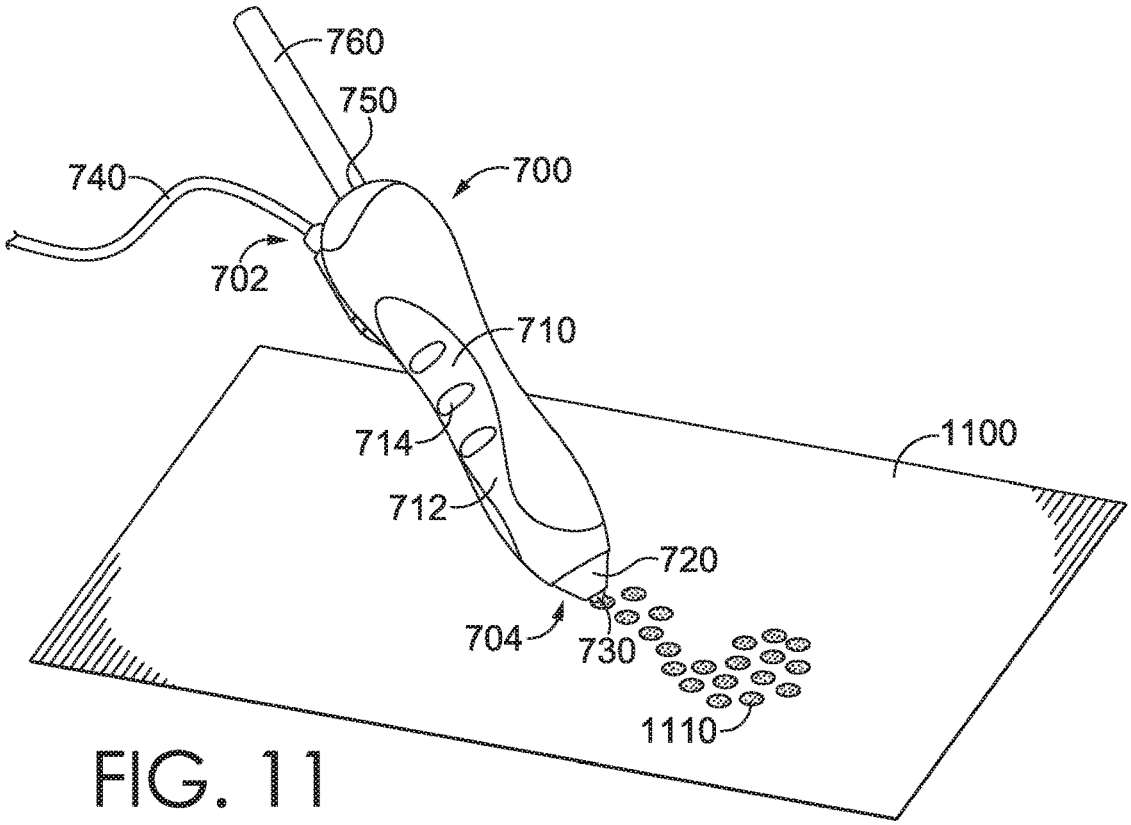
FIG. 11 depicts the applicator wand in FIG. 7 as used for making a non-continuous marking on a receiving medium, in accordance with aspects herein.

FIGS. 10 and 11 depict, for example, applicator wand 700 in use. As briefly described above, the applicator wand 700 in accordance with aspects herein may be used to created different effects on a receiving surface (e.g., encaustic gesso treated canvas, paper, glass, fabric, and the like, that may be suitable for receiving the melted crayon or other melted marking material). The applicator wand 700 may be used to create continuous markings, such as the continuous marking 1010 shown on receiving surface 1000, or non-continuous markings, such as the dot markings 1110 shown on receiving surface 1100. The dot markings 1110 are only exemplary, and it is contemplated that broken markings may take on any shape or form such as, for example, organic shapes (i.e. random/non-uniform shapes), geometric shapes (e.g., circle, square, oval, triangle, and the like), and may be of any desired size.

Figure 12:
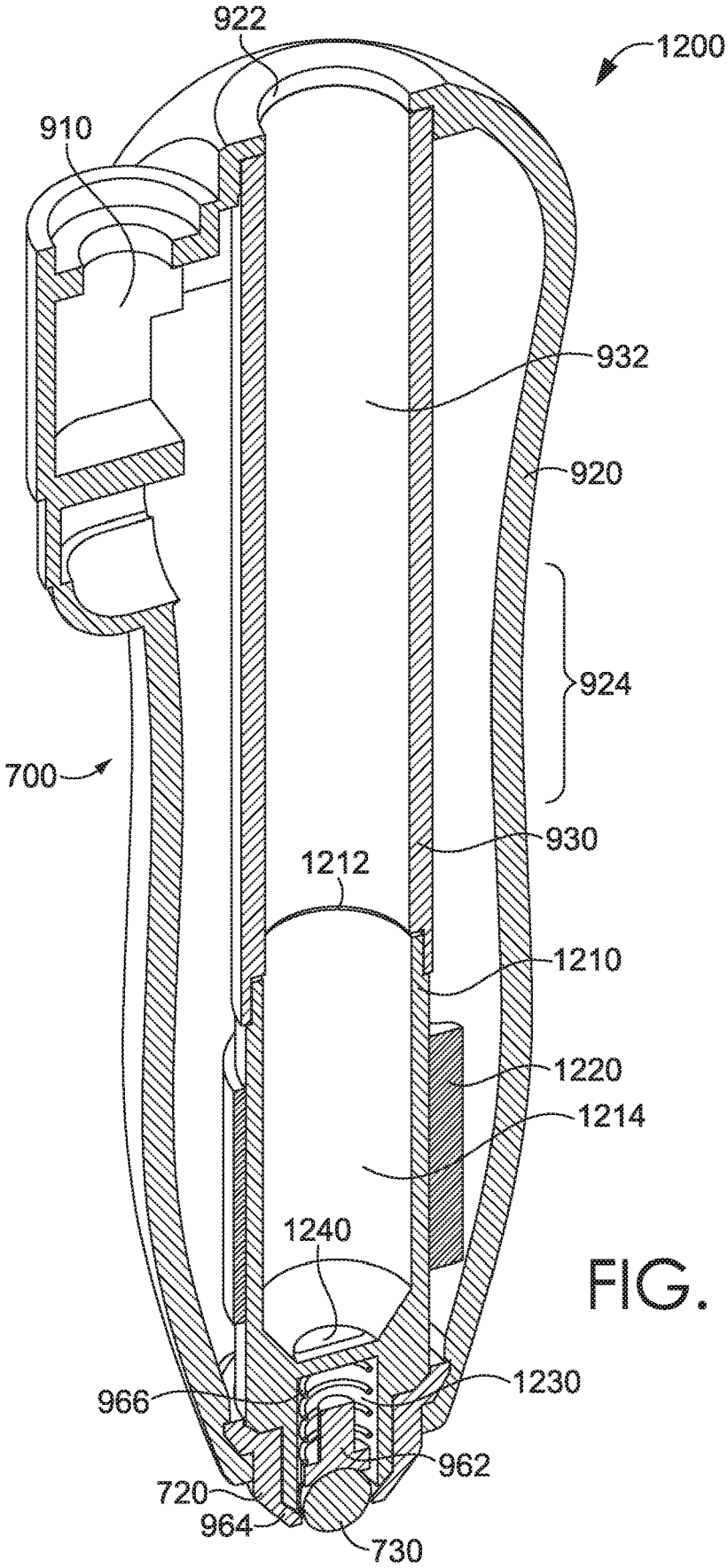
FIG. 12 depicts a cross-sectional perspective view of the applicator wand in FIG. 7, in accordance with aspects herein.

FIG. 12 depicts a cross-sectional perspective view 1200 of an alternative construction of applicator wand 700, in accordance with aspects herein. A crayon or other solid marking material (not shown), may fall into the interior cavity 932 of an interior shell 930 by, for example, a gravitational pull, when the applicator wand 700 is in a substantially upright orientation. The interior shell 930 may be generally configured to hold a crayon or other solid marking material in place, and an exterior shell 920 may be generally configured to wrap around the interior shell 930 and provide an ergonomic shape to the applicator wand 700. As described above with reference to FIG. 9, the exterior shell 920 may also define a power source cavity 910, in which a power source (not shown), such as a power cord, may be securely accommodated. As described above, at least the interior shell 930 may be comprised of a heat-resistant or semi-heat resistant plastic or thermoplastic material such as, for example, polypropylene, thermoplastic polyurethane (TPU), and the like. The exterior shell 920 may be comprised of a hard plastic, wood, or metal, or mixture thereof that may form a non-thermally conductive shell. A grip portion 924 may optionally, further comprise, for example, a rubber coating and/or a foam coating, and/or discrete rubber or foam pads for comfort and to create a frictional surface to improve grip (make the grip portion 924 substantially non-slippery).

A heat engine 1210 may be directly coupled to the interior shell 930 at a joint 1212, for example, to ensure that the crayon or other marking material to be melted is directly guided to a cavity 1214 of the heat engine 1210. As the heat engine 1210 increases in temperature to melt the crayon or other solid marking material, the cavity 1212 may also serve as a reservoir for storing the melted crayon or other marking material until released onto a substrate surface. The heat engine 1210 may further comprise a heat engine component 1220 that is configured to wrap around the heat engine 1210 and cover up a substantial portion of the heat engine 1210 for providing heat to the heat engine 1210. The heat engine component 1220 may be comprised of a wire, such as a heating wire (e.g., NiCr wire) so that when the applicator wand is plugged it, it is configured to heat up the heat engine 1210. A thermistor (not shown) may also be provided as a temperature control for preventing overheating or for maintaining a particular desired temperature. The heat engine 1210 may be maintained at a desired optimal temperature for changing a physical state of the crayon or other solid marking material to a melted or fluid crayon or other melted marking material. The melted or fluid crayon or other melted marking material may flow through opening 1240 and may be retained in place or, in other words, prevented from flowing out of the reservoir tip 1230 of the heat engine 1210 when the applicator wand 700 is not in use. This may be done by, for example, a spring loaded system comprised of spring 966 and roller ball securing component 962 and the roller ball 730. When the spring 966 is in its rest (i.e., extended) state, the spring may be configured to apply pressure (i.e., push) outward, thereby pushing the roller ball securing component 962 and the roller ball 730 outward, causing one of or both of the roller ball securing component 962 and the roller ball 730 to engage with a perimeter of the retaining portion 964 to restrict flow of melted or fluid crayon or other melted marking material out of the applicator tip 720, when not in use. When in use, flow of the melted crayon or other melted marking material may be started by the user applying a downward pressure to the applicator wand 700, which would cause the spring 966 to contract, disengaging the roller ball securing component 962 and the roller ball 730 from the perimeter of the retaining portion 964. In other aspects, the spring 966 may be used for aiding in the exchanging of applicator tips, when interchangeable tips are provided (e.g., spring loaded tip on/tip off mechanism). It is contemplated that the spring 966 may be useful in these and other types of flow control or other mechanisms without departing from aspects herein.

Figure 13:
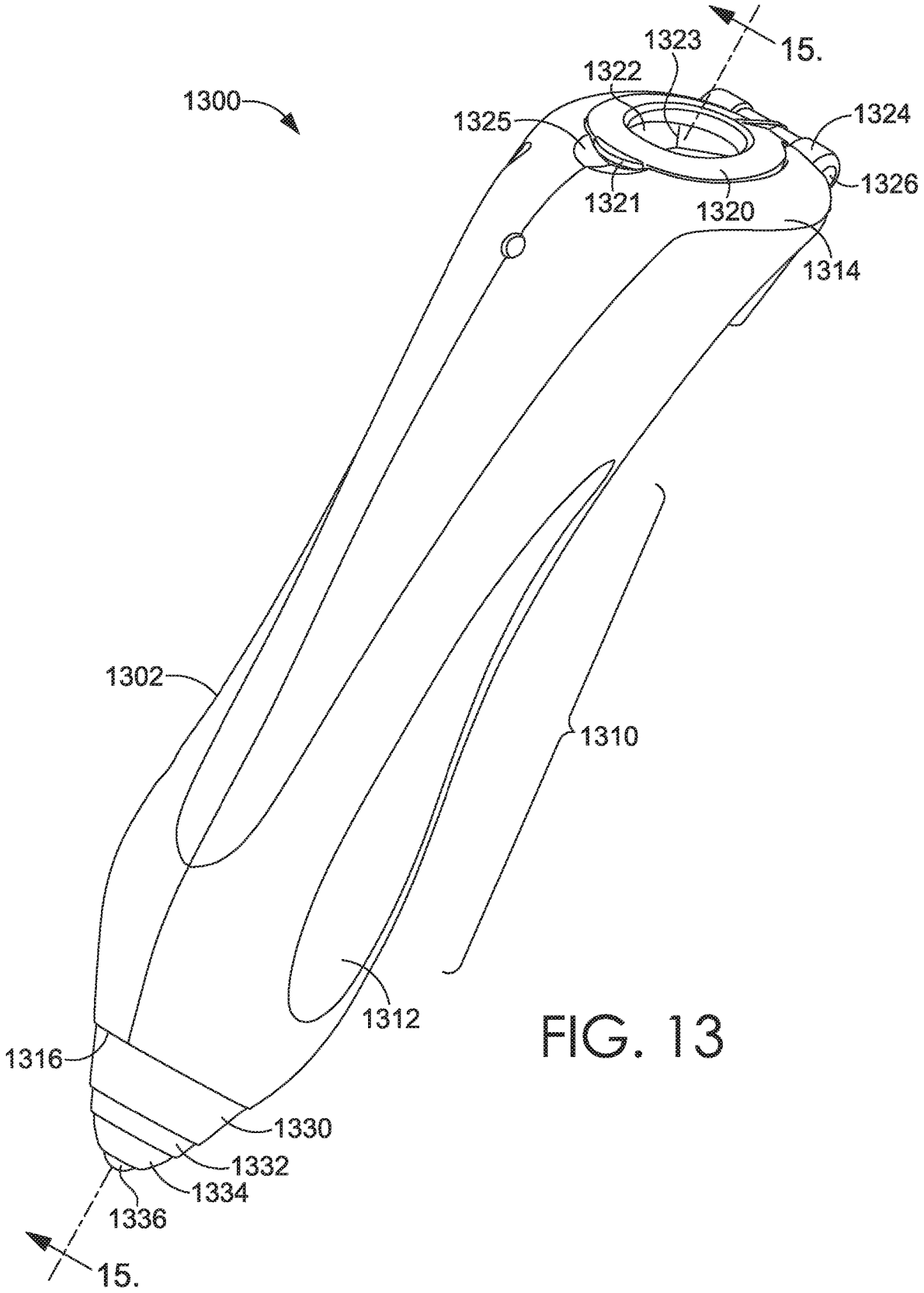
FIG. 13 depicts a perspective view of another exemplary applicator wand in accordance with aspects herein.

Moving on to FIG. 13, a perspective view of another exemplary applicator wand 1300 is shown. Applicator wand 1300 may comprise an ergonomic design configured to comfortably fit into a child or adult hand measuring for example, between 10 cm and 16 cm in length (l), between 2 cm and 5 cm in width (w), and between 3 cm and 6 cm in height (h), at its widest and highest portions since the ergonomic shape may cause different sections of the applicator wand 1300 to have different heights and widths along the length (l) of the applicator wand 1300. For example, a specific exemplary applicator wand in accordance with aspects herein may have, for example, a length (1) of 15.19 cm (~5.98 in), a width (w) of 3.63 cm (~1.43 in), and a height (h) of 5.11 cm (~2.01 in) at its widest and highest sections. The applicator wand 1300 may comprise a gripping portion 1310 on the housing 1302, the housing 1302 may comprise one or more cushion elements 1312 formed from a soft rubber or foam material at the gripping portion 1310 to provide a comfortable non-slip grip on the applicator wand 1300. Further, the applicator wand 1300 may comprise a housing door 1320 and a door seal 1322 at a top end 1314. The housing door 1320 may be hingedly attached to the housing 1302 by a door hinge 1324 connected with a door pin 1326. The housing door 1320 may be opened to insert a crayon or other solid marking material into a cavity (not shown) of the applicator wand 1300, and it may be closed prior to activating the heating engine (not shown) of the applicator wand 1300. The housing door 1320 may comprise sensors in communication with the heating engine so that the heating engine may not be activated unless the housing door 1320 is in a closed position for safety. This is because the housing door 1320, when appropriately closed, may prevent backflow of any melted or fluid material through the top end 1314 of the applicator wand 1300. Optionally, the door seal 1322 may be comprised of a polymer rubber or silicone material with slits 1323. The slits 1323 may be configured to allow a crayon or other solid marking material to be inserted into the cavity (not shown) of the applicator wand 1300 without opening the housing door 1320. For example, a crayon or other solid marking material may be pushed through the slits 1323, which may force the door seal 1322 to open at the slits 1323. Once the crayon or other solid marking material is completely inside of the cavity of the applicator wand 1300, the door seal 1322 may "self-heal" or in other words, the slits 1323 may return to their original state, thereby allowing the door seal 1322 to close so that any back flow of a fluid or melted crayon or other melted marking material is prevented in the case where the applicator wand 1300 is dropped or miss handled. In other words, the slits 1323 are configured to form a one-way entrance for the crayon or other solid marking material into the cavity of the applicator wand 1300. Further, the applicator wand 1300 may comprise a tip housing 1330 configured to connect a tip 1334 of the applicator wand 1300 to the bottom end 1316 of the housing 1302. The tip 1334 may comprise a roller ball 1336 (as shown), or any of the tips previously described with reference to, for example, FIGS. 3A-3F. The tip 1334 may be housed in a tip housing 1330, which may comprise a tip fitting perimeter 1332 to securely hold the tip 1334 in place. As further discussed with reference to FIGS. 3A-3F, the tip 1334 may be made to be interchangeable by switching out the tip 1334 from the tip housing 1330.

Figure 14:
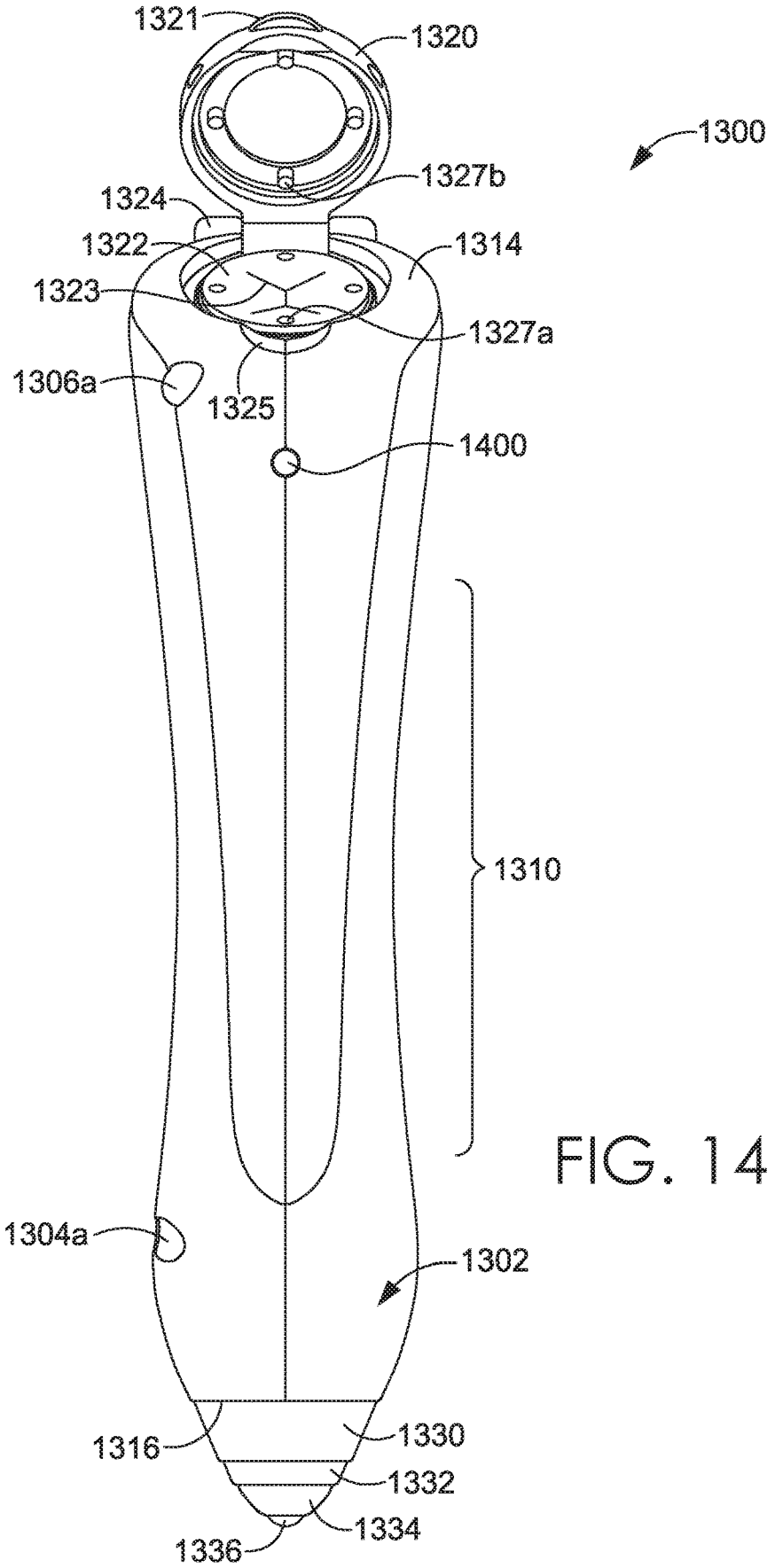
FIG. 14 depicts a different perspective view of the exemplary applicator wand in of FIG. 13 with its housing door component removed, in accordance with aspects herein.

Moving on to FIG. 14, a different perspective view of the wand 1300 is shown with the housing door 1320 in an open configuration. As shown in FIG. 14, the door seal 1322 may be secured to the housing 1302 by, for example, securely fitting into the housing cavity designated for the door seal 1322. Further, the door seal 1322 may be further secured by the housing door 1320 by one or more seal securing mechanisms formed by holes 1327*a* in the door seal 1322 and pegs 1327*b* shown on the housing door 1320. The pegs 1327*b* may slide into corresponding holes 1327*a* in the door seal 1322. Other possibilities for the one or more seal securing mechanisms may include one or more protrusions on the door seal 1322 that may be fitted to corresponding openings in the housing 1302 and/or housing door 1320. It should be understood that these are exemplary possibilities for the one or more seal securing mechanisms 1327, however, other mechanisms may also be employed without departing from the aspects described herein. Further, as seen in FIG. 14, the housing 1302 may comprise a lip portion 1321 aligned with a housing door tab portion 1325 (shown in FIG. 13) on the housing door 1320 in order to facilitate the opening and closing of the housing door 1320. In other words, a housing door tab portion 1325 may be provided on housing door 1320 to provide an anchoring point for, for example, a fingertip (not shown) of a user when the user wants to open the applicator wand 1300. Further, FIG. 14 provides a better view of the ergonomic shape of the applicator wand 1300, which is slimmer at the gripping portion 1310 than at least the top end 1314. The housing 1302 may comprise one or more pieces that may be secured to each other by, for example, screws (not shown) fitted into screw fittings, for example, fittings 1304*a*, 1304*b* (shown in FIG. 15A), 1306*a* and 1306*b* (shown in FIG. 15A). Additionally, the applicator wand 1300 may comprise an LED indicator light 1400 also shown in FIG. 14 that may be configured to indicate to the user when the applicator wand 1300 is ready for use and when the applicator wand 1300 is not ready for use. For example, the LED indicator light 1400 may start by showing as red to indicate that the applicator wand 1300 is not ready for use as it is starting to heat up and once it is ready to use, the LED indicator light 1400 may change to green. Also, the LED indicator light 1400 may be configured to flash or change to yet a different color when the reservoir needs to be refilled with more crayon or other marking material, for example. This may be achieved by including a sensor that uses, for example, the change in capacitance in the heat engine 1550 (shown in FIG. 16) due to differences in insulation sensed by the sensor to electronically detect the levels of melted crayon or other melted marking material in the heating engine 1550. Another way of indicating to a user that the applicator wand 1300 needs a refill may be via a window on the side of the applicator wand 1300 to indicate the levels of melted crayon or other melted marking material present inside of the applicator wand 1300. This could be achieved for example, by using a clear heating element using Silver (Ag) stacked film inside of a polycarbonate/acrylic tube to directly heat the crayon or other marking material.

Figure 15A:
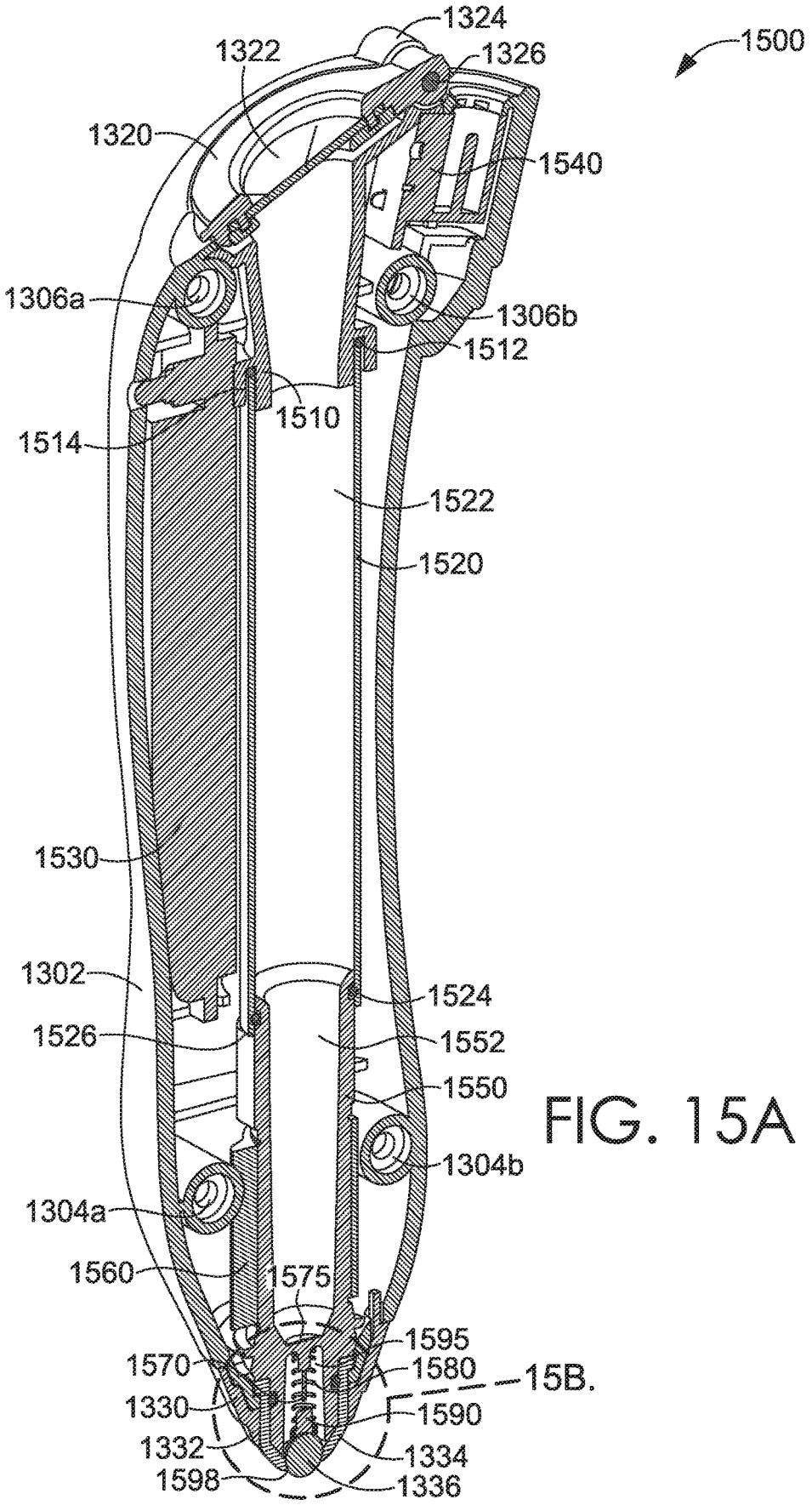
FIG. 15A depicts a cross-sectional view of the exemplary applicator wand in FIG. 13, in accordance with aspects herein.

FIG. 15A offers a cross-sectional view of the exemplary applicator wand 1300 to view the interior components, in accordance with aspects herein. A crayon or other solid marking material (not shown), may fall into an interior cavity 1522 of the interior tube 1520 formed, for example, by a combination of the tube end 1510, which may be directly connected to the interior tube 1520 at joint 1514, wherein the joint 1514 may be cushioned by an elastomeric "O" ring 1512, once the crayon or other solid marking material is inserted through the door seal 1322 or by opening the housing door 1320. Further, the "O" ring may also act as a sealant to prevent leakage of any liquefied crayon or other melted material through the joints. The interior tube 1520 may in turn be directly connected to a heat engine 1550 having an interior cavity 1552. The interior tube 1520 may be tube oriented along a longitudinal axis of the applicator wand 1300 to lengthwise fit a crayon or other solid marking material. Once the crayon or other solid marking material is inserted inside the interior cavity 1522 of the interior tube 1520 and enters into the interior cavity 1552 of the heat engine 1550, the crayon or other solid marking material may be melted when the heat engine 1550 is heated. In order to prevent overheating or excess heat transfer, the heat engine 1550 may comprise a heating element 1560 wrapped around the heat engine 1550 that in accordance to aspects herein, may apply the heat to the heat engine 1550. As shown, the heat engine 1550 is in close proximity to the tip 1334 and its components in order to maximize heat transfer to the tip 1334 so as to prevent any premature solidification of the melted crayon or other melted marking material inside of the tip, in particular the tip reservoir 1595.

The heat engine 1550 may be heated by activating the heating element 1560 (shown in FIG. 16), which may receive electrical energy from a battery or a power cord (not shown), that may be connected to the heating element 1560 through a barrel connector jack 1540. If provided with an electrical cord, the applicator wand 1300 may further comprise cord controls such as a retractable cord, a plug and lock-in cord so that the applicator wand 1300 doesn't become unplugged while in use, or a quick-release cord that may become automatically unplugged if the applicator wand 1300 becomes overheated. The thermal fuse may be located in close proximity or next to the heating element 1560 so that if the operating temperatures of the applicator wand exceed the safety temperature threshold, it may break to break the circuit and stop any current from flowing into the heating element 1560. The threshold temperature may, for example, be set not to exceed 93.3° C. (~200° F.). The threshold temperature may be set between 43.3° C. (~110° F.) and 71.1° C. (~160° F.). In accordance with aspects herein, the applicator wand 1300 may comprise different temperature settings to control the rate at which the crayon or other solid marking material melts. For example, the crayon or other solid marking material may melt more slowly at 43.3° C. than at 71.1° C. The temperature settings of the heating element 1560 may be controlled by, for example, a thermistor (not shown), which may be in direct communication with the heating element 1560 through a printed circuit board (PCB) (1530 shown in FIG. 16). Further, at least the interior tube 1520 may be comprised of a heat conductive material such as a metal, for example, copper, aluminum, iron, and the like. The housing 1302, as described with respect to the other embodiments of the invention, may be comprised of a hard plastic, wood, or a mixture thereof that may form a non-thermally conductive shell.

Figure 15B:
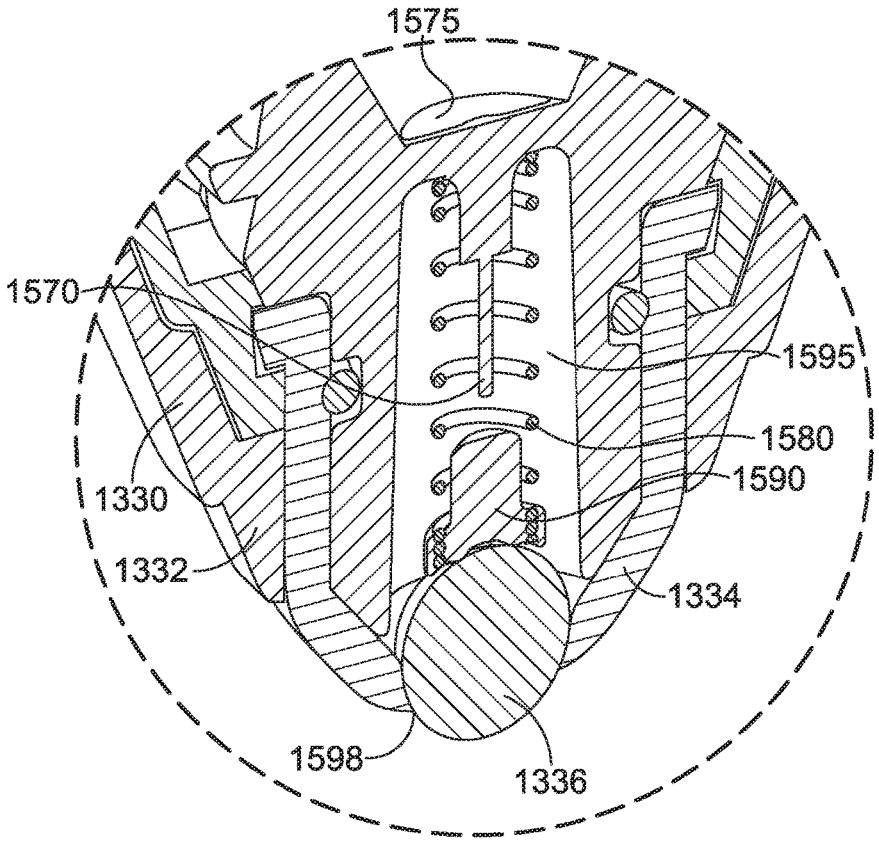
FIG. 15B depicts a cross-sectional view of the tip of the exemplary applicator wand in FIG. 13 in a "not in use" state.
Figure 15C:
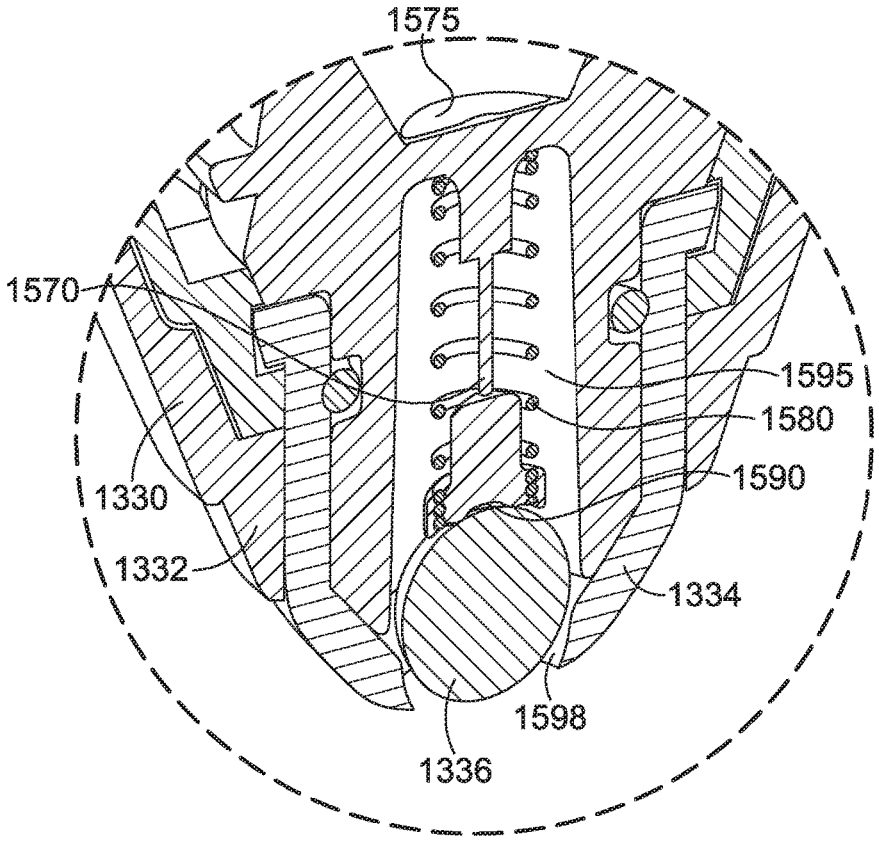
FIG. 15C depicts a cross-sectional view of the tip of the exemplary applicator wand in FIG. 13 in an "in use" state.

A heat engine 1550 may be directly coupled to the interior tube 1520 at a joint 1526 and the joint 1526 may be cushioned by an elastomeric "O" ring 1524. Further, the "O" ring may also act as a sealant to prevent leakage of any liquefied crayon or other melted material through the joints. As the heating element 1560 increases in temperature to melt the crayon or other solid marking material inside the heat engine 1550 and interior tube 1520, the melted crayon or other melted marking material may flow from the heat engine 1550 into the tip reservoir 1595 though an opening 1575. When the roller ball 1336 is pushed up, the roller ball securing component 1590 may be pushed up, compressing the spring 1580, up to the stopper 1570 as can be better seen in FIGS. 15B and 15C. The heat engine 1550 and the tip reservoir 1595 may serve as a reservoir for storing the melted crayon or other melted marking material until released onto the surface of a substrate (not shown). In other words, the melted crayon or other melted marking material may be prevented from flowing out of the tip reservoir 1595 when the applicator wand 1300 is not in use by providing a spring loaded system comprised of the spring 1580, roller ball securing component 1590, and the roller ball 1336. The stopper 1570 serves to limit an amount of pressure that may be applied to the roller ball 1336 in order to control a flow rate and prevent the melted crayon or other melted marking material from rushing out of the applicator wand in an uncontrolled manner. When the spring 1580 is in its rest (i.e., extended) state, the spring 1580 may be configured to apply pressure (i.e., push) outward, thereby pushing the roller ball securing component 1590 and the roller ball 1336 outward, causing one of or both of the roller ball securing component 1590 and the roller ball 1336 to engage with a tip perimeter 1598 of the tip 1334 to restrict flow of the melted or fluid crayon or other melted marking material out of the tip 1336, when the applicator wand 1300 is not in use. When the applicator wand 1300 is in use, flow of the melted crayon or other melted marking material may be started by the user applying a downward pressure to the applicator wand 1300, which would cause the spring 1580 to contract, disengaging the roller ball securing component 1590 and the roller ball 1336 from the tip perimeter 1598 of the tip 1334 and also causing the roller ball securing component 1590 to engage the stopper 1570 to allow flow of the melted crayon or other melted marking material through the tip reservoir 1595, out of the tip 1336, and onto a receiving surface or substrate (not shown). In other aspects, the spring 1580 may be used for aiding in the exchanging of applicator tips, when interchangeable tips are provided (e.g., spring loaded tip on/tip off mechanism). FIGS. 15B and 15C offer close up views of the cross-sectional view of the tip reservoir 1595 (in FIG. 15A) in a "not in use" state (FIG. 15B) and in an "in use" state (FIG. 15C), showing how the spring loaded system described above blocks flow of the melted crayon or other melted marking material in the "in use" state and allows flow of the melted crayon or other melted marking material in the "not in use" state. It is also contemplated that other types of flow control mechanisms may also be used without departing from aspects herein.

Figure 16:
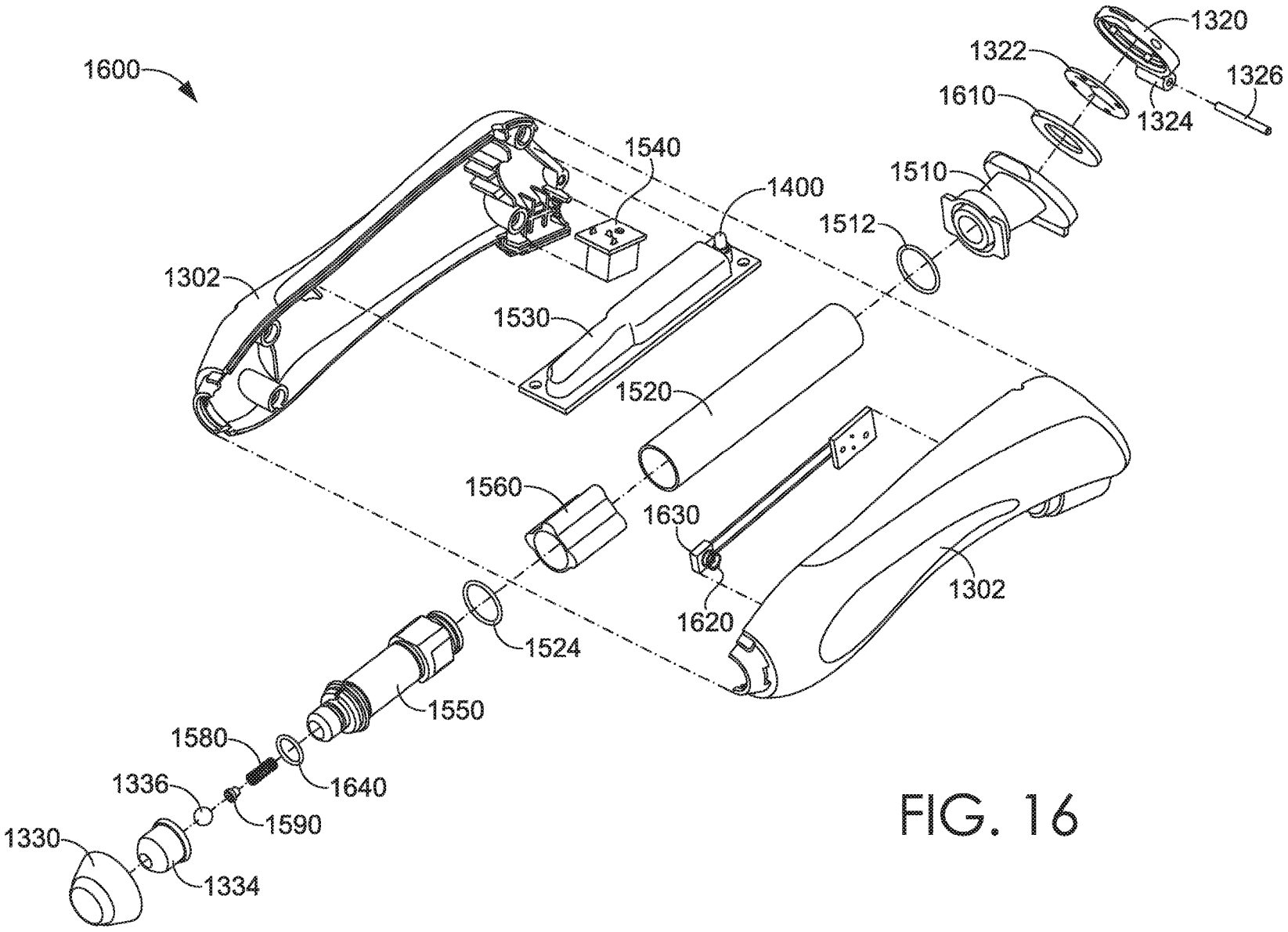
FIG. 16 depicts a deconstructed view of the exemplary applicator wand in FIG. 13, in accordance with aspects herein.

FIG. 16 shows a deconstructed view 1600 of the applicator wand 1300 showing, at a high level, some of the internal components of the applicator wand 1300. It is to be noted that although some components such as, for example, the safety sensors comprising temperature regulation components described herein may be analog in nature, it is also envisioned that components and sensors within the applicator wand in accordance with aspects herein may be replaced with digital or other type counterparts as needed or desired, without departing from aspects described herein. Turning now to FIG. 16, the applicator wand 1300 may comprise at least a barrel connector jack 1540, a PCB 1530, thermal fuse 1630, a heating element 1560, and a set of one or more LED indicators as the electrical component within. The barrel connector jack 1640 provides a connection port to an AC current outlet for a plug in version of the applicator wand 1300. The barrel connector jack may include a rectifier (not shown) to convert the AC current coming in from the electrical outlet to DC current used for operation of the electrical and heating components of the applicator wand 1300. The PCB 1530 may house one or more logic components and may also interconnect several elements including an LED indicator 1400, amongst other elements. The heating element 1560 may be comprised of at least a heating wire (e.g., NiCr wire) configured to be wrapped around the heat engine 1550 and a thermistor configured to detect a temperature of the heating element and relay it to the PCB 1530. As described above, a digital temperature sensor may also be used in accordance with aspects herein for temperature detection. The working temperatures used in accordance with aspects herein may range from 40° C. to 85° C. As a safety measure, a thermal fuse 1630 may be placed adjacent to the heating element 1560 so that if temperatures rise above, for example above 93° C. (~200° F.) the thermal fuse 1630 can break the circuit so that electrical power is essentially cut off from the heating element 1560 to stop overheating to unsafe levels. The thermal fuse 1630 may be a single use thermal fuse or a multi-use thermal fuse. A spring 1620 may be provided between the thermal fuse and the housing 1302 for pushing the thermal fuse against the heating element 1560 for ensuring maximum contact and minimizing delay in breaking if the temperatures of the heating element reach unsafe levels.

The heat engine 1550 and the interior tube 1520 may be comprised of a heat conductive material (e.g., aluminum, silver, steel, copper, or metal infused polymeric compositions for clear walled embodiments where the melted crayon may be made visible to a user through a viewing window that, although not shown, may be provided on the housing 1302) so that when the heat engine 1550 is heated by the heating element 1560, the heat may travel through the interior tube 1520 as well in order to possibly soften the crayon or other marking material, prior to it entering the heat engine 1550. As well, the heat present in the interior tube 1520 may help keep the internal wall of the interior tube 1520 free of unmelted residue. An "O" ring 1524 may be provided at the joint joining the interior tube 1520 to the heat engine 1550 in order to prevent leakage and provide cushioning at the joint. Another "O" ring 1640 may be provided between the tip 1334 and the heat engine 1550 for the same purpose, and yet another "O" ring 1512 may be provided at the joint between the interior tube 1520 and the tube end 1510, also for preventing leakage and for providing cushioning at the joint. The tube end 1510 may be comprised of poor thermal conductor such as silicone, plastic, rubber, wood, and the like since a portion of the tube end 1510 is exposed as part of the housing 1302 of the applicator wand 1300, and the user may come into contact with it during operation of the applicator wand 1300.

In order to prevent back flow of any melted crayon or melted marking material, the tube end may be further provided with a housing door 1320 configured to securely retain any melted crayon or other melted marking material within the interior cavity formed by the tube end 1510 and the interior tube 1520. Further, as described above, the housing door 1320 may comprise a door seal 1322 of a silicone or other rubber type material that is able to self-heal when the crayon has been inserted through it. The door seal 1322 may be secured to the housing door 1320 with a seal retaining ring 1610 that is configured to securely fit into a groove of the housing door 1320, therefore, only leaving a central portion of the door seal 1322 exposed for allowing insertion of the crayon or other marking material through the door seal 1322.

Figure 17:
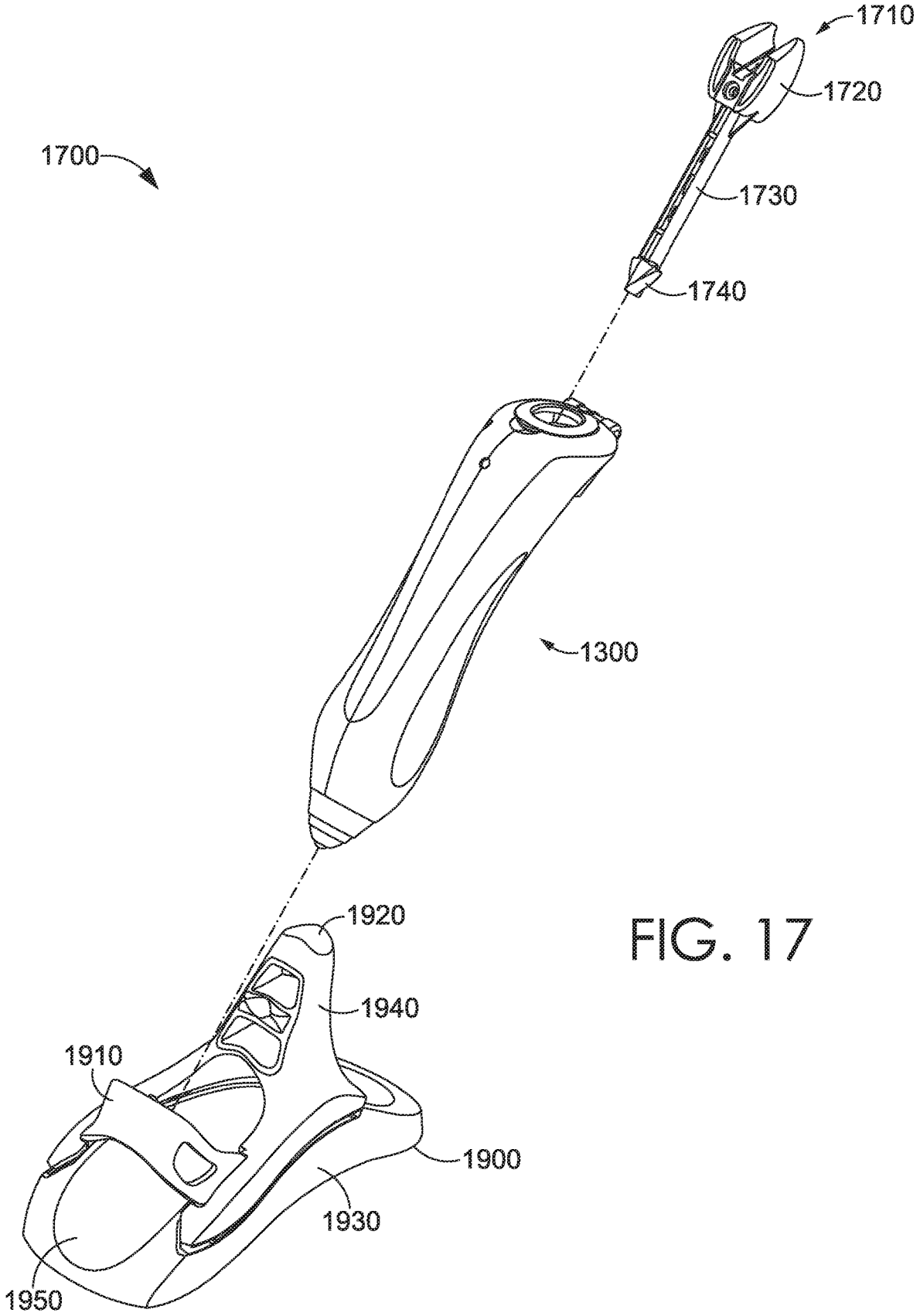
FIG. 17 depicts a kit with the applicator wand in FIG. 13, the kit including a stand and a cleaning tool, in accordance with aspects herein.

FIG. 17 depicts a kit 1700 comprising an applicator wand 1300, an applicator wand stand 1900 and an applicator cleaning tool 1710. The applicator wand cleaning tool 1710 may be comprised of plastic, metal, wood, or other suitable materials. The applicator wand cleaning tool 1710 may be a one piece structure or, a multi-component structure that generally comprises a grip portion 1720 that could also have a built in label cutter, an elongated rod portion 1730, and a cleaning portion 1740. The label cutter built into the grip portion 1720 may have a stainless steel or ceramic blade that is sharp enough to cut through a crayon label but that is blunt or not through sharp enough to cause injury to a user. In accordance with other aspects, the label cutter may be provided as a separate piece. The elongated rod portion 1730 may be particularly configured to at least reach down to the joint 1514 between the tube end 1510 and the interior tube 1520 (as shown in FIG. 15A). The cleaning portion 1740 is shaped like a drill bit with spiral flutes that are configured to scrape off any residual crayon or other solid marking material that may have solidified along the interior walls of the interior tube 1520 so that the interior cavity 1522 of the interior tube 1520 is not obstructed. Further, cleaning out any residual solidified crayons or other marking materials would prevent undesired color mixing inside of the applicator wand 1300 when the crayon or other solid marking material is melted. Although not shown, the kit 1700 may further comprise stencils, stamps, scribbling tools, and the like for embellishment of the melted crayon or other melted marking material after it has been applied onto a substrate, or embellishment of the solidified crayon or other marking material applied onto the substrate.

The applicator wand stand 1900 functions in a similar way as the applicator wand stand 800 shown in FIG. 8. The applicator wand stand 1900 may comprise at least a front holder portion 1910, a base portion 1930, and a rear stand portion 1940 having a base 1920 for resting the applicator wand 1300. The front holder portion 1910 may be configured to securely hold the applicator wand 1300 at an angle from an orthogonal orientation relative to the base 1920. Further, the base portion 1920 of the applicator wand stand 1900 may comprise a voided portion 1950 for accommodating the tip 1334 and the roller ball 1336 of the applicator wand 1300, in order to prevent the roller ball 1336 from touching any surface while the applicator wand 1300 is in the applicator wand stand 1900. In other words, when the applicator wand 1300 is rested in the applicator wand stand 1900, the roller ball 1336 is "free floating" in order to prevent any pressure that may be exerted on the spring loaded system of the tip, which if depressed, would cause the melted crayon or other melted marking material to flow.

The applicator wand stand 1900 depicted in FIG. 17, may be provided with stabilizing components such as suction cups, and the like, in order to prevent tipping when used for a corded applicator wand 1300, for example. In a different aspect, the applicator wand 1300 may be provided with a kickstand (not shown) so that a separate applicator wand stand 1900 may not be needed. For safety, the applicator wand 1300 may be provided with an auto-shut off feature that may operate according to a timer. For example, if the applicator wand 1300 is sitting idle in its resting position for a predetermined threshold of time (e.g., 10 minutes), the applicator wand 1300 or the heating element 1560 within the applicator wand 1300 may be automatically shut OFF (turned OFF) until the user turns it back ON, or until an active position is detected or sensed.

Figure 18:
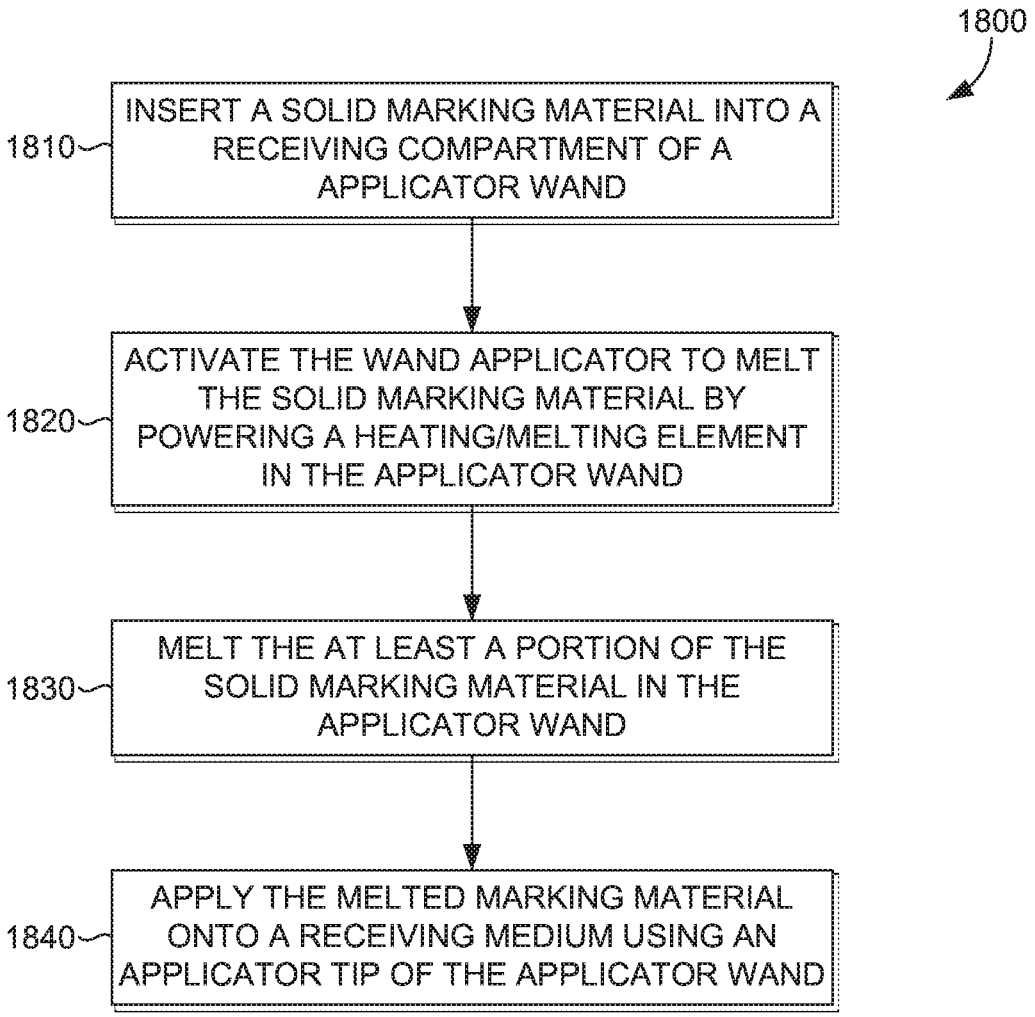
FIG. 18 depicts a method of using the applicator wand in accordance with aspects herein.

Moving on to FIG. 18, a method of using an applicator wand is provided in accordance with aspects herein. The method comprises the steps of inserting one or more crayons or other solid marking materials into a receiving compartment of the applicator want as shown at step 1810. Then, the applicator wand may be activated by plugging it into an electrical outlet or turning an on/off switch on or off to power the applicator wand. The on/off switch may also work when powering the applicator wand from a battery source. The activation may start a heating process of the heating element/melting element of the applicator wand as shown at step 1820. Once the heating/melting element are sufficiently heated, the melting process of the crayon or other solid marking material may be started inside the applicator wand by melting at least a portion of the crayon or other solid marking material, as shown at step 1830. Once a sufficient quantity of crayon or other solid marking material has been melted, the applicator tip may be used to apply the melted crayon or other melted marking material onto a receiving medium to create a desired design/drawing/art piece, as shown at step 1840. It should be noted that the steps outlined in FIG. 18 depict an exemplary sequence of steps. One of ordinary skill in the art should recognize that the steps outlined in FIG. 18 can be performed in any order without departing from aspects described herein.

The aspects described throughout this specification are intended in all respects to be illustrative rather than restrictive. Upon reading the present disclosure, alternative aspects will become apparent to ordinary skilled artisans that practice in areas relevant to the described aspects without departing from the scope of this disclosure. In addition, aspects of this technology are adapted to achieve certain features and possible advantages set forth throughout this disclosure, together with other advantages which are inherent. It will be understood that certain features and subcombinations are of utility and may be employed without reference to other features and subcombinations. This is contemplated by and is within the scope of the claims. Further, since many different styles of applicator wands may be made of the invention without departing from the scope thereof, it is to be understood that all matter herein set forth or shown in the accompanying drawings is to be interpreted as illustrative and not in a limiting sense.

The invention claimed is:

1. An applicator wand comprising:

a housing;

an interior tube oriented along a longitudinal axis of the applicator wand located internal to the housing, the interior tube having a hollow interior cavity configured to receive at least one meltable solid marking material at a first end of the interior tube;

a heat engine adjacent to a second end of the interior tube also located internal to the housing, the heat engine comprising a heating element, wherein the heat engine is configured to receive at least a portion of the received at least one meltable solid marking material in the interior tube, wherein the applicator wand comprises an insulating space between the heat engine and the housing; and an applicator tip adjacent the heat engine, the applicator tip configured to dispense a melted quantity of the portion of the received at least one meltable solid marking material from the heat engine, wherein the applicator tip comprises a roller ball tip.

2. The applicator wand of claim 1, further comprising a power source, wherein the power source is one or more of a battery power source and an electrical power source.

3. The applicator wand of claim 1, wherein the power source is directly coupled to the heating element, wherein the heating element is comprised of a heating wire.

4. The applicator wand of claim 1, wherein the applicator wand comprises a temperature sensor for controlling the temperature of the heating element up to a threshold temperature.

5. The applicator wand of claim 1, wherein the applicator tip is an interchangeable applicator tip such that one or more of an applicator tip mechanism, an applicator tip material, and an applicator tip size may be changed with respect to the applicator wand.

6. The applicator wand of claim 5, wherein the interchangeable applicator tip comprises one or more of a brush tip, a sponge tip, a pin-style valved system tip, and a felt tip.

7. The applicator wand of claim 1, wherein the applicator tip selectively dispenses the melted quantity of the portion of the received at least one meltable solid marking material based on one or more of:

an angle of position of the applicator wand with respect to a marking surface;

an amount of pressure applied to the marking surface by contact with at least a portion of the applicator tip;

a position of one or more stopping and starting features of the applicator tip; and a position of one or more stopping and starting features of the receiving compartment.

8. The applicator wand of claim 1 further comprising an on and off switch for controlling a state of power applied to the heating element.

9. The applicator wand of claim 1 further comprising a safety sensor associated with the melting compartment.

10. The applicator wand of claim 9, wherein the safety sensor automatically shuts off the heating element when the heating element reaches a maximum threshold temperature.

11. The applicator wand of claim 10, wherein the threshold temperature is between 40° C. and 80° C.

12. The applicator wand of claim 1, wherein the meltable solid marking material received by the receiving compartment comprises a crayon.

13. An applicator wand comprising:

a receiving compartment for receiving a solid marking material;

a melting compartment comprising a heating element for melting a portion of the solid marking material advancing from the receiving compartment and through the melting compartment;

an applicator tip for dispensing melted marking material received from the melting compartment, wherein the applicator tip comprises a roller ball tip; and a housing along the applicator wand, the housing enclosing the melting compartment and restricting access to the heating element, wherein the applicator wand comprises an insulating space between the melting compartment and the housing.

14. The applicator wand of claim 13 further comprising a release mechanism for controlling the feeding of the solid marking material to the heating element.

15. The applicator wand of claim 13, wherein the housing comprises a non-thermally conductive casing.

16. The applicator wand of claim 15, wherein the housing further encloses at least a portion of the receiving compartment, the housing providing access to the receiving compartment at a first end of the applicator wand and coupling to the applicator tip at a second end of the applicator wand, the second end being opposite the first end along an axis of the applicator wand.

17. The applicator wand of claim 13, wherein the solid marking material is a crayon.

18. An applicator wand kit comprising;

an applicator wand cleaning tool;

an applicator wand stand; and an applicator wand, the applicator wand comprising:

an interior tube for receiving a solid marking material;

a heat engine comprising a heating element adjacent to the heat engine for melting a portion of the solid marking material advancing from the interior tube into the heat engine;

an applicator tip for dispensing melted marking material received from the heat engine, wherein the applicator tip comprises a roller ball tip; and a housing enclosing the interior tube, the heat engine, the heating element, and for securing the applicator tip, wherein the applicator wand comprises an insulating space between the heat engine and the housing.

19. The applicator wand kit of claim 18, wherein the applicator tip is interchangeable.

20. The applicator wand kit of claim 19, further comprising a plurality of differently colored crayons.

* * * * *